US011879172B2

(12) United States Patent
Takagi et al.

(10) Patent No.: US 11,879,172 B2
(45) Date of Patent: Jan. 23, 2024

(54) METHOD FOR PRODUCING CHEMICALLY TREATED ALLOY MATERIAL, AND CHEMICAL TREATMENT SOLUTION REGENERATION APPARATUS USED IN METHOD FOR PRODUCING CHEMICALLY TREATED ALLOY MATERIAL

(71) Applicant: NIPPON STEEL CORPORATION, Tokyo (JP)

(72) Inventors: Takamitsu Takagi, Tokyo (JP); Makoto Miyajima, Tokyo (JP); Keishi Matsumoto, Tokyo (JP); Sayuri Iwata, Tokyo (JP); Akira Tsuto, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 757 days.

(21) Appl. No.: 16/760,139

(22) PCT Filed: Nov. 21, 2018

(86) PCT No.: PCT/JP2018/043073
§ 371 (c)(1),
(2) Date: Apr. 29, 2020

(87) PCT Pub. No.: WO2019/103067
PCT Pub. Date: May 31, 2019

(65) Prior Publication Data

US 2020/0283907 A1 Sep. 10, 2020

(30) Foreign Application Priority Data

Nov. 24, 2017 (JP) ..... 2017-226309
Apr. 11, 2018 (JP) ..... 2018-076359

(51) Int. Cl.
*C23C 22/46* (2006.01)
*C23C 22/86* (2006.01)
(Continued)

(52) U.S. Cl.
CPC ..... *C23C 22/86* (2013.01); *C23C 22/34* (2013.01); *C23C 22/46* (2013.01)

(58) Field of Classification Search
None
See application file for complete search history.

(56) References Cited

U.S. PATENT DOCUMENTS 3,879,237 A 4/1975 Faigen et al.

FOREIGN PATENT DOCUMENTS

DE 1057847 B 5/1959
JP 62199778 A 9/1987
(Continued)

OTHER PUBLICATIONS

Int'l. Search Report of PCT/JP2018/043073, dated Feb. 12, 2019.

*Primary Examiner* — Lois L Zheng
(74) *Attorney, Agent, or Firm* — Greer, Burns & Crain, Ltd.

(57) ABSTRACT

A method for producing a chemically treated alloy material is provided that suppresses a decrease in chemical treatability even in a case where chemical treatment is repeatedly performed. The method for producing a chemically treated alloy material of the present disclosure includes a chemical treatment step and a treatment solution regeneration step. In the chemical treatment step, an alloy material (6) is immersed in an oxalate treatment solution (4) containing oxalate ions and fluorine ions to perform a chemical treatment. In the treatment solution regeneration step, light is radiated to the oxalate treatment solution (4) during the chemical treatment and/or the oxalate treatment solution (4) after the chemical treatment.

18 Claims, 11 Drawing Sheets

(51) Int. Cl.
*C23C 22/34* (2006.01)
*C23C 22/00* (2006.01)

(56) References Cited

FOREIGN PATENT DOCUMENTS

| | | | |
|---|---|---|---|
| JP | 63045382 | A | 2/1988 |
| JP | 02149677 | A | 6/1990 |
| JP | 05026872 | A | 2/1993 |
| JP | 05339794 | A | 12/1993 |
| JP | 06220651 | A | 8/1994 |
| JP | 2003171777 | A | 6/2003 |
| JP | 2006037933 | A | 2/2006 |
| JP | 2007064634 | A | 3/2007 |
| JP | 2008036591 | A | 2/2008 |
| JP | 2014043606 | A | 3/2014 |
| WO | 0204707 | A1 | 1/2002 |

METHOD FOR PRODUCING CHEMICALLY TREATED ALLOY MATERIAL, AND CHEMICAL TREATMENT SOLUTION REGENERATION APPARATUS USED IN METHOD FOR PRODUCING CHEMICALLY TREATED ALLOY MATERIAL

This is a National Phase Application filed under 35 U.S.C. § 371, of International Application No. PCT/JP2018/043073, filed Nov. 21, 2018, the contents of which are incorporated by reference.

TECHNICAL FIELD

The present disclosure relates to a method for producing a chemically treated alloy material, and a chemical treatment solution regeneration apparatus that is used in the method for producing a chemically treated alloy material.

BACKGROUND ART

The surface of an alloy material is subjected to chemical treatment for the purpose of imparting performance such as corrosion resistance, galling resistance, lubricity and paint adhesiveness to the alloy material. Examples of the chemical treatments include a phosphate treatment, an oxalate treatment and a chromate treatment. Among such chemical treatments, an oxalate treatment is performed for the purpose of increasing the lubricity, galling resistance and the like of the alloy material surface. An oxalate coating that is formed on an alloy material surface by an oxalate treatment increases the adhesiveness to the alloy material surface of a lubricating film that is to be formed thereon. In this way, the oxalate coating increases the lubricity and galling resistance of the alloy material surface.

For example, Japanese Patent Application Publication No. 2006-37933 (Patent Literature 1) discloses a technique that provides a high chromium steel piston that has excellent galling resistance by forming an oxalate coating on the surface of a piston for use in an internal combustion engine.

An oxalate treatment is usually performed by immersing an alloy material in an oxalate treatment solution containing oxalate ions, and causing a reacting between the alloy material surface and the oxalate treatment solution. In the case of performing an oxalate treatment on a plurality of alloy materials, usually the oxalate treatment solution is used continuously. The chemical treatability decreases as the number of alloy materials that are successively treated increases. If the chemical treatability decrease, in some cases defects occur in the formation of the oxalate coating. Further, it is known that, in a case where the alloy material contains a large amount of Cr, that is, is a so-called "difficult-to-chemically-treat material", even when the usage count of the oxalate treatment solution is low, the chemical treatability decrease. In such a case, defects may occur in the formation of an oxalate coating. Therefore, various studies have been conducted regarding techniques for suppressing a decrease in the chemical treatability.

Japanese Patent Application Publication No. 2003-171777 (Patent Literature 2), Japanese Patent Application Publication No. 2-149677 (Patent Literature 3) and Japanese Patent Application Publication No. 2014-43606 (Patent Literature 4) propose oxalate treatment solutions that can suppress a decrease in chemical treatability. On the other hand, Japanese Patent Application Publication No. 62-199778 (Patent Literature 5) and Japanese Patent Application Publication No. 6-220651 (Patent Literature 6) propose chemical treatment methods that can suppress a decrease in chemical treatability.

A treatment solution for forming an oxalate coating disclosed in Patent Literature 2 is characterized by containing a polyoxyethylene-polyoxypropylene block copolymer in an amount of 0.03 to 1.0 wt % that is obtained by adding ethylene oxide of 20 to 50 wt % with respect to the total molecular weight to propylene glycol. It is described in Patent Literature 2 that by this means, in a method that performs cold drawing of stainless pipes, a reduction in the defect rate of products as well as suppression of a decrease in the life time of the oxalate coating treatment solution are achieved.

A chemical treatment solution for cold working of stainless steel disclosed in Patent Literature 3 contains oxalic acid, and is characterized in that phosphoric acid is contained in an amount such that a phosphate ion concentration in the treatment solution falls within a range of 0.03 to 0.6 g/L. It is described in Patent Literature 3 that by this means, even though the balance of the composition of the chemical treatment solution becomes unbalanced to a certain extent, a chemical treatment solution is obtained that can form, on the surface of stainless steel, a chemical coating which can maintain favorable galling resistance.

An oxalate chemical treatment method disclosed in Patent Literature 4 is characterized by adding sulfite as an accelerating agent to an oxalate chemical treatment solution to perform a chemical treatment. It is described in Patent Literature 4 that by this means an oxalate coating can be formed on a material which has high corrosion resistance, such as a high corrosion-resistant stainless pipe.

A method for forming an oxalate coating on Cr—Ni stainless steel disclosed in Patent Literature 5 is characterized by performing a sulfuric acid treatment immediately before an oxalate coating forming treatment. It is described in Patent Literature 5 that by this means the reactivity between the starting material and the oxalate treatment solution increases, and oxalate coating forming treatment can be performed efficiently even with respect to high Ni steel for which it had conventionally not been possible to perform an oxalate coating forming treatment on.

A method for performing lubrication treatment of a highly corrosion resistant metal material disclosed in Patent Literature 6 is characterized by forming an oxalate coating without performing a pickling treatment after performing a shot blasting treatment with iron and steel shot on the surface of a metal material, and subsequently performing a lubrication treatment. It is described in Patent Literature 6 that by this means, even in the case of a metal material with high corrosion resistance on which it is difficult to perform a chemical treatment, a chemical coating can be sufficiently formed, and an appropriate lubrication treatment can be performed.

CITATION LIST

Patent Literature

Patent Literature 1: Japanese Patent Application Publication No. 2006-37933
Patent Literature 2: Japanese Patent Application Publication No. 2003-171777
Patent Literature 3: Japanese Patent Application Publication No. 2-149677
Patent Literature 4: Japanese Patent Application Publication No. 2014-43606
Patent Literature 5: Japanese Patent Application Publication No. 62-199778

Patent Literature 6: Japanese Patent Application Publication No. 6-220651

SUMMARY OF INVENTION

Technical Problem

When the techniques described above are used, a decrease in chemical treatability can be suppressed. On the other hand, it would also be good if a decrease in chemical treatability can be suppressed by another method other than the techniques described above.

An objective of the present disclosure is to provide a method for producing a chemically treated alloy material which suppresses a decrease in chemical treatability even in a case where chemical treatment is repeatedly performed, and a chemical treatment solution regeneration apparatus that can suppress a decrease in the chemical treatability of an alloy material even in a case of producing a chemically treated alloy material using an oxalate treatment solution with which chemical treatment is repeatedly performed.

Solution to Problem

The method for producing a chemically treated alloy material of the present disclosure includes a chemical treatment step and a treatment solution regeneration step. In the chemical treatment step, an alloy material is immersed in an oxalate treatment solution containing oxalate ions and fluorine ions to perform a chemical treatment. In the treatment solution regeneration step, light is radiated to the oxalate treatment solution during the chemical treatment and/or the oxalate treatment solution after the chemical treatment.

The chemical treatment solution regeneration apparatus of the present disclosure includes a treatment solution regeneration bath and a light radiation apparatus. The treatment solution regeneration bath is capable of containing an oxalate treatment solution during chemical treatment of an alloy material or after the chemical treatment of an alloy material. The oxalate treatment solution contains oxalate ions and fluorine ions. The light radiation apparatus includes one or more light source members. At least one part of the light source member is disposed inside the treatment solution regeneration bath or in the vicinity of an outer side of the treatment solution regeneration bath. The light radiation apparatus is capable of radiating light at the oxalate treatment solution during the chemical treatment or after the chemical treatment.

Advantageous Effects of Invention

According to the method for producing a chemically treated alloy material of the present disclosure, a decrease in chemical treatability is suppressed even in a case where chemical treatment is repeatedly performed. The chemical treatment solution regeneration apparatus of the present disclosure can suppress a decrease in the chemical treatability of an alloy material even in the case of producing a chemically treated alloy material using an oxalate treatment solution with which chemical treatment is repeatedly performed.

DESCRIPTION OF EMBODIMENTS

Figure 1:
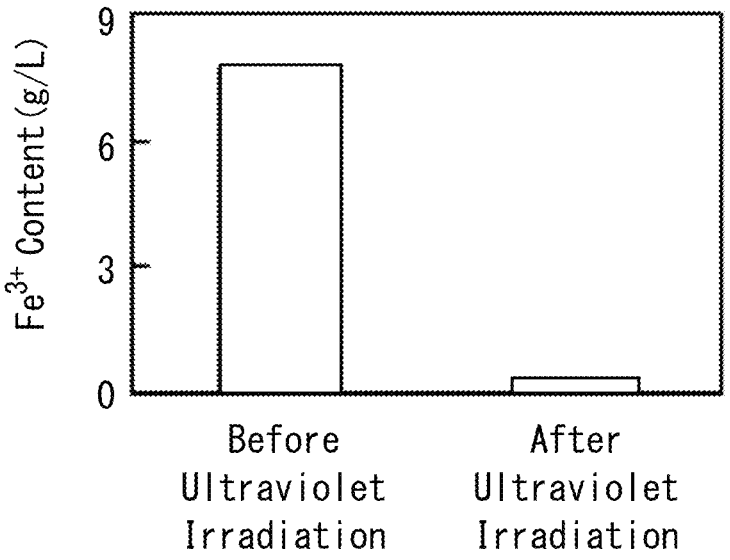
FIG. 1 is a view showing the content of trivalent iron ions of an oxalate treatment solution after use for chemical treatment of an alloy material, before and after ultraviolet irradiation.

An oxalate coating is a coating that is consisting of iron (II) oxalate (chemical formula: $Fe(COO)_2$) and impurities. An oxalate coating is formed as the result of iron ions that are eluted from an alloy material and oxalate ions contained in an oxalate treatment solution reacting at the alloy material surface. The formation process of iron (II) oxalate in a chemical treatment is, specifically, shown by the following reaction formulae.

$$Fe \rightarrow Fe^{2+} + 2e^- \quad (1)$$

$$(COOH)_2 \rightarrow (COO)_2^{2-} + 2H^+ \quad (2)$$

$$2H^+ + 2e^- \rightarrow H_2\uparrow \quad (3)$$

$$(COO)_2^{2-} + Fe^{2+} \rightarrow Fe(COO)_2 \quad (4)$$

Fluorine ions are added into the oxalate treatment solution to accelerate the above reactions. Fluorine ions have an etching action. If fluorine ions are contained in an oxalate treatment solution for chemical treatment, the fluorine ions destroy an oxide film (passivation film) that is formed on the surface of the base metal surface in the process of producing an alloy material. As a result, formation of an oxalate coating is promoted. In addition, an oxalate coating can also be formed on a stainless alloy material having a passivation film with high corrosion resistance.

It is already known that an oxalate treatment solution containing oxalate ions and fluorine ions deteriorates due to repetitive use of the oxalate treatment solution. If the oxalate treatment solution deteriorates, the chemical treatability may decrease. If the chemical treatability decrease, in some cases defects may occur in the formation of an oxalate coating. Further, it is known that, in a case where the alloy material contains a large amount of Cr, that is, the alloy material is a so-called "difficult-to-chemically-treat material", even when the usage count of the oxalate treatment solution is low, the chemical treatability are low.

Conventionally, these problems have been dealt with by adding an etching agent such as sodium bifluoride into the oxalate treatment solution or by raising the treatment temperature. Further, in a case where the problems could not be dealt with by the above methods, the entire oxalate treatment solution is discarded and replaced. In the case of treating a difficult-to-chemically-treat material, measures such as imparting surface roughness to the alloy material surface or imparting iron content to the alloy material surface have been adopted. On the other hand, detailed studies had heretofore not been conducted with regard to the cause of a deterioration in an oxalate treatment solution and the cause of defects in the formation of an oxalate coating.

Therefore, the present inventors conducted a detailed study regarding the cause of a deterioration in an oxalate treatment solution and the cause of a decrease in chemical treatability. As a result, the present inventors obtained the findings described hereunder that had not been known before now.

During chemical treatment, iron from the base metal dissolves and iron ions are generated. At such time, a part of the iron of the base metal dissolves as divalent iron ions ($Fe^{2+}$), as shown in the above Formula (1). The divalent iron ions react with oxalate ions to form iron (II) oxalate. Iron (II) oxalate is an insoluble salt. Therefore, when iron dissolves as divalent ions from the alloy material surface and reacts with oxalate ions, iron (II) oxalate rapidly deposits on the alloy material surface. The deposited iron (II) oxalate forms an oxalate coating.

On the other hand, a part of the iron that eluted from the base metal is present in the oxalate treatment solution as trivalent iron ions ($Fe^{3+}$). The trivalent iron ions do not contribute to formation of the oxalate coating. That is, it is not the case that all of the iron ions that eluted from the base metal are consumed by the formation of an oxalate coating. A part of the iron ions do not participate in formation of the oxalate coating, and are present in the oxalate treatment solution.

The trivalent iron ions react with fluorine ions in the manner shown in the following Formula (5) to form a complex (chemical formula: $[FeF_6]^{3-}$). When a complex is formed, the etching action disappears, and destruction of the oxide film (passivation film) is suppressed.

$$Fe^{3+} + 6F^- \rightarrow [FeF_6]^{3-} \quad (5)$$

If an oxalate treatment solution is used repetitively and a plurality of alloy materials are immersed in the same oxalate treatment solution, the iron ion content of the oxalate treatment solution increases. If the iron ion content of the oxalate treatment solution increases, complex formation between iron ions and fluorine ions proceeds. That is, if an oxalate treatment solution is used repetitively, the etching action decreases. As a result, destruction of the oxide film (passivation film) is suppressed and the chemical treatability decrease. The present inventors clarified for the first time that this is the cause of deterioration in an oxalate treatment solution.

Further, an alloy material which contains a large amount of Cr, that is, a so-called "difficult-to-chemically-treat material", includes a passivation film that has markedly high corrosion resistance on the surface thereof. Therefore, in the case of performing an oxalate treatment on a difficult-to-chemically-treat material, it is necessary to more actively maintain the etching action of fluorine ions. However, if iron dissolves during the oxalate treatment and forms a complex with fluorine ions, the number of fluorine ions may be reduced and the etching action may decrease, and therefore it may be difficult to destroy the passivation film. Consequently, defects may occur in the formation of the oxalate coating.

As described above, it has been found that the cause of a decrease in chemical treatability is a decrease in the etching action of fluorine ions. Therefore, the present inventors studied methods for restoring and maintaining the etching action of fluorine ions in an oxalate treatment solution. As a result, the present inventors obtained the following findings.

As described above, iron ions in an oxalate treatment solution react with fluorine ions to form a complex. In this regard, the present inventors had the idea that if the iron ion content of an oxalate treatment solution can be reduced, reaction with fluorine ions (complex formation) can be suppressed. As the result of various studies, the present inventors obtained the new finding that the iron ion content of an oxalate treatment solution can be reduced by the simple method of radiating light at the oxalate treatment solution.

FIG. 1 is a view that illustrates the trivalent iron ion content of an oxalate treatment solution after being used for chemical treatment of an alloy material (an oxalate treatment solution after performing a chemical treatment of immersing a stainless pipe for approximately two hours in a treatment bath that contained approximately 15000 L of oxalate treatment solution with respect to a pipe having a total area of approximately 25000 $m^2$ calculated by surface area conversion) with respect to before and after ultraviolet irradiation. The ordinate in FIG. 1 represents the trivalent iron ion content (g/L) of the oxalate treatment solution. The trivalent iron ion content of the oxalate treatment solution before ultraviolet irradiation is shown on the left side, and the trivalent iron ion content of the oxalate treatment solution after ultraviolet irradiation is shown on the right side in FIG. 1. Referring to FIG. 1, it is found that the trivalent iron ion content decreases when the used oxalate treatment solution is subjected to ultraviolet irradiation.

Figure 2:
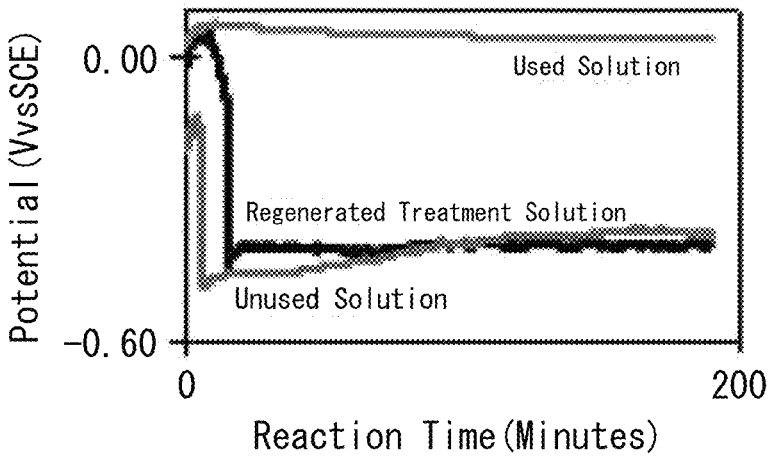
FIG. 2 is a view showing the potential on the surface of an alloy material in cases where the alloy material was subjected to chemical treatment using an unused oxalate treatment solution, a used oxalate treatment solution, and a regenerated treatment solution.

Next, the present inventors performed a chemical treatment on an alloy material using an oxalate treatment solution after ultraviolet irradiation (hereunder, referred to simply as "regenerated treatment solution"). FIG. 2 is a view illustrating the potential on an alloy material surface in a case where the alloy material was subjected to chemical treatment using an unused oxalate treatment solution (shown as "unused solution" in FIG. 2), a used oxalate treatment solution (shown as "used solution" in FIG. 2), and an oxalate treatment solution that was a solution obtained when ultraviolet light was radiated to a used oxalate treatment solution (shown as "regenerated treatment solution" in FIG. 2). The abscissa in FIG. 2 represents the reaction time (minutes). The ordinate in FIG. 2 represents the potential (VvsSCE) on the alloy material surface. In a case where a dissolution reaction of an oxide film on the alloy material surface is proceeding, and in a case where a dissolution reaction of the base metal is proceeding, the surface potential of the alloy material becomes lower (becomes base). That is, when a formation reaction of an oxalate coating is proceeding, a state in which the potential on the alloy material surface is low (is base) is maintained. In contrast, when a formation reaction of an oxalate coating is not proceeding, a state in which the potential on the alloy material surface is high (is noble) is maintained.

Referring to FIG. 2, in the case where the unused oxalate treatment solution (referred to as "unused solution" in FIG. 2) was used, the potential was high for a very early period of the reaction. This is because the oxide film on the alloy material surface was dissolving. However, immediately thereafter the potential decreases and a low state of about −0.40 V was maintained for around 200 minutes. On the other hand, in the case where a used oxalate treatment solution (referred to as "used solution" in FIG. 2) was used, the potential maintained a comparatively high state of about 0.00 V from the initial state of the reaction until the end of the test (approximately 200 minutes). In the case where the oxalate treatment solution after ultraviolet irradiation (regenerated treatment solution) was used, the potential was comparatively high for a very early period of the reaction. However, immediately thereafter the potential decreased, and after around 20 minutes became the same potential as the potential of the unused oxalate treatment solution. Thereafter, the low potential state was maintained until around 200 minutes had passed. Thus, by radiating ultraviolet light at a used oxalate treatment solution, the chemical treatability was restored to the same level as the chemical treatability of an unused oxalate treatment solution, and hence high chemical treatability were maintained.

The reason why the chemical treatability of a used oxalate treatment solution are restored to and maintained at the same level as the chemical treatability of an unused oxalate treatment solution by radiating ultraviolet light at the used oxalate treatment solution is thought to be as follows.

If the complex formed as shown in Formula (5) is irradiated with ultraviolet light, trivalent iron ions are reduced to divalent iron ions as shown in Formula (6). At this time, fluorine ions are released from the complex. The released fluorine ions regain an etching action and contribute to destruction of the oxide film (passivation film). As a result, the chemical treatability of the used oxalate treatment solution are restored.

$$[FeF_6]^{3-}+e^- \rightarrow Fe^{2+}+6F^- \quad (6)$$

In addition, the divalent iron ions react with oxalate ions in accordance with Formula (4) to form insoluble iron (II) oxalate. At this time, fluorine ions are further released from the complex. The released fluorine ions regain an etching action. Thus, by irradiation with ultraviolet light, reduction of trivalent iron ions followed by formation of insoluble salt occurs, and fluorine ions are thereby released. Therefore, by irradiation with ultraviolet light, the chemical treatability of a used oxalate treatment solution are restored to the same level as the chemical treatability of an unused oxalate treatment solution.

On the other hand, trivalent iron ions eluted from the base metal react with oxalate ions to form iron (III) oxalate (chemical formula: $Fe_2(C_2O_4)_3$). Iron (III) oxalate has a property of decomposing to insoluble iron (II) oxalate and carbon dioxide under light irradiation. By this means, the trivalent iron ion content of the oxalate treatment solution is decreased. As a result, reaction between fluorine ions and iron ions is suppressed. That is, the etching activity of the fluorine ions is maintained, and high chemical treatability are maintained.

$$2[Fe(C_2O_4)_3]^{3-} \rightarrow 2Fe(COO)_2+2CO_2+3(COO)_2^{2-} \quad (7)$$

Based on these results, the present inventors discovered a method for producing a chemically treated alloy material that can maintain the etching action of fluorine ions and suppress a decrease in chemical treatability by the simple technique of radiating light. According to the method for producing a chemically treated alloy material of the present disclosure, it is not necessarily required to add a component (in particular, an etching agent such as sodium bifluoride) to an oxalate treatment solution or to discard and replace an oxalate treatment solution or the like. Further, even in the case of using a difficult-to-chemically-treat material, an additional step such as imparting surface roughness thereto is not necessarily required.

In addition, the present inventors concluded that if an apparatus is equipped with, for example, a treatment solution regeneration bath capable of containing an oxalate treatment solution during chemical treatment or after chemical treatment of an alloy material, and a light radiation apparatus capable of radiating light at an oxalate treatment solution during chemical treatment or after chemical treatment, the apparatus can be used in a method for producing a chemically treated alloy material as described above.

A method for producing a chemically treated alloy material of the present disclosure, which has been completed based on the above findings, includes a chemical treatment step and a treatment solution regeneration step. In the chemical treatment step, an alloy material is immersed in an oxalate treatment solution containing oxalate ions and fluorine ions to perform a chemical treatment. In the treatment solution regeneration step, light is radiated to the oxalate treatment solution during the chemical treatment and/or the oxalate treatment solution after the chemical treatment.

The method for producing a chemically treated alloy material of the present disclosure includes a treatment solution regeneration step. By means of the treatment solution regeneration step, an etching action of fluorine ions is restored, and the iron ion content of the oxalate treatment solution decreases. If the iron ions in the oxalate treatment solution are decreased, the action of fluorine ions of the oxalate treatment solution is more actively maintained. As a result, even in a case where chemical treatment is repeatedly performed, a decrease in the chemical treatability can be suppressed. In the present description, a coating consisting of iron (II) oxalate and impurities is referred to as an "oxalate coating". In the present description, an alloy material that includes an oxalate coating on the surface thereof is referred to as a "chemically treated alloy material". In the present description, the meaning of the term "oxalate ions" includes both oxalate ions (chemical formula: $C_2O_4^{2-}$) and hydrogen oxalate ions (chemical formula: $HC_2O_4$).

Preferably, in the aforementioned treatment solution regeneration step, light is radiated to the oxalate treatment solution while causing the oxalate treatment solution to flow.

In this case, light can be radiated more efficiently at the oxalate treatment solution.

Preferably, in the aforementioned treatment solution regeneration step, wavelengths of the light include a wavelength in the ultraviolet range.

In a case where the wavelengths of light that a light source member emits are short wavelengths of high intensity, a decomposition reaction of iron (III) oxalate to iron (II) oxalate is further accelerated. Therefore, a wavelength of the light is preferably a wavelength in the ultraviolet range. Here, the phrase "a wavelength in the ultraviolet range" means a wavelength in the range of 10 to 400 nm.

Preferably, the method for producing a chemically treated alloy material further includes a step of adding oxalate ions to the oxalate treatment solution.

Oxalate ions are consumed as the iron ion content of the oxalate treatment solution is reduced. If a step of adding oxalate ions is included, consumed oxalate ions are replenished. Therefore, the chemical treatment is accelerated.

Preferably, the aforementioned oxalate treatment solution further contains nitrate ions.

In this case, the chemical treatment is accelerated.

Preferably, the aforementioned oxalate treatment solution further contains thiosulfate ions.

In this case, the chemical treatment is accelerated.

The aforementioned alloy material may contain 10.5% or more of Cr.

According to the method for producing a chemically treated alloy material of the present disclosure, even in a case of repeatedly performing a chemical treatment using an alloy material containing a large amount of Cr, a decrease in the chemical treatability can be suppressed.

A chemical treatment solution regeneration apparatus of the present disclosure is a chemical treatment solution regeneration apparatus that is used to produce a chemically treated alloy material. The chemical treatment solution regeneration apparatus includes a treatment solution regeneration bath and a light radiation apparatus. The treatment solution regeneration bath is capable of containing an oxalate treatment solution during chemical treatment of an alloy material or after the chemical treatment of an alloy material. The oxalate treatment solution contains oxalate ions and fluorine ions. The light radiation apparatus includes one or more light source members. At least one part of the light source member is disposed inside the treatment solution regeneration bath or in the vicinity of an outer side of the treatment solution regeneration bath. The light radiation apparatus is capable of radiating light at the oxalate treatment solution during the chemical treatment or after the chemical treatment.

The chemical treatment solution regeneration apparatus of the present disclosure includes a light radiation apparatus. The light radiation apparatus is capable of radiating at the oxalate treatment solution during the chemical treatment or after the chemical treatment by means of one or more light source members. Thus, the oxalate treatment solution can be subjected to a regeneration treatment. As a result, a decrease in chemical treatability can be suppressed even in a case where chemical treatment is repeated.

Preferably, at least one part of the light source member is immersible in the oxalate treatment solution in the treatment solution regeneration bath.

By immersing at least one part of the light source member in the oxalate treatment solution in the treatment solution regeneration bath, the distance between the light source and the oxalate treatment solution is shortened. Therefore, stronger light can be radiated to the oxalate treatment solution. As a result, the oxalate treatment solution can be subjected to regeneration treatment more efficiently.

Preferably, the chemical treatment solution regeneration apparatus includes a flow mechanism that causes the oxalate treatment solution in the treatment solution regeneration bath to flow.

If the oxalate treatment solution in the treatment solution regeneration bath is caused to flow by the flow mechanism, the amount of oxalate treatment solution to be irradiated with light increases. As a result, the oxalate treatment solution can be subjected to regeneration treatment more efficiently.

The chemical treatment solution regeneration apparatus may further include a chemical treatment bath. The chemical treatment bath is capable of containing the oxalate treatment solution after the oxalate treatment solution was irradiated with the light by the light radiation apparatus in the treatment solution regeneration bath. A chemical treatment can be performed in the chemical treatment bath by immersing the alloy material in the oxalate treatment solution contained therein. In a case where the chemical treatment solution regeneration apparatus includes a chemical treatment bath, the flow mechanism includes a first liquid supply channel and a second liquid supply channel. The first liquid supply channel conveys the oxalate treatment solution in the treatment solution regeneration bath to the chemical treatment bath. The second liquid supply channel conveys the oxalate treatment solution in the chemical treatment bath to the treatment solution regeneration bath.

When the chemical treatment solution regeneration apparatus further includes a chemical treatment bath, the chemical treatment and the regeneration of the oxalate treatment solution can be performed in separate baths. By circulating the oxalate treatment solution between the chemical treatment bath and the treatment solution regeneration bath by means of the first liquid supply channel and the second liquid supply channel, even in a case of performing chemical treatments in succession, a decrease in the chemical treatability can be continued to be suppressed.

The chemical treatment bath may include a first chemical treatment bath and a second chemical treatment bath. In this case, the first liquid supply channel includes a first liquid supply channel main body, a first chemical-treatment-bath-side discharge port and a second chemical-treatment-bath-side discharge port. The first liquid supply channel main body has two end portions on the chemical treatment bath side. The first chemical-treatment-bath-side discharge port is formed at one of the end portions on the chemical treatment bath side of the first liquid supply channel main body, and discharges the oxalate treatment solution in the first liquid supply channel main body into the first chemical treatment bath. The second chemical-treatment-bath-side discharge port is formed at the other of the end portions on the chemical treatment bath side of the first liquid supply channel main body, and discharges the oxalate treatment solution in the first liquid supply channel main body into the second chemical treatment bath. Further, the second liquid supply channel includes a second liquid supply channel main body, a first chemical-treatment-bath-side inflow port and a second chemical-treatment-bath-side inflow port. The second liquid supply channel mail body has two end portions on the chemical treatment bath side. The first chemical-treatment-bath-side inflow port is formed at one of the end portions on the chemical treatment bath side of the second liquid supply channel main body, and allows the oxalate treatment solution in the first chemical treatment bath to flow into the second liquid supply channel main body. The second chemical-treatment-bath-side inflow port is formed at the other of the end portions on the chemical treatment bath side of the second liquid supply channel main body, and allows the oxalate treatment solution in the second chemical treatment bath to flow into the second liquid supply channel. In this case, the aforementioned flow mechanism further includes a discharge port switching mechanism and an inflow port switching mechanism. The discharge port switching mechanism switches whether to cause the oxalate treatment solution in the first liquid supply channel main body to be discharged from the first chemical-treatment-bath-side discharge port or from the second chemical-treatment-bath-side discharge port. The inflow port switching mechanism switches whether to allow the oxalate treatment solution to flow into the second liquid supply channel main body from the first chemical-treatment-bath-side inflow port or from the second chemical-treatment-bath-side inflow port.

The chemical treatment bath may include a first chemical treatment bath and a second chemical treatment bath, and may use a discharge port switching mechanism and an inflow port switching mechanism to perform switching to cause either of the oxalate treatment solution in the first chemical treatment bath and the oxalate treatment solution in the second chemical treatment bath to circulate. In this case, the oxalate treatment solution can be caused to circulate in an alternate manner between the first chemical treatment bath and the second chemical treatment bath.

Preferably, the flow mechanism includes an under-regeneration-treatment-solution circulation channel that causes the oxalate treatment solution in the treatment solution regeneration bath to circulate. The under-regeneration-treatment-solution circulation channel includes an under-regeneration-treatment-solution circulation channel main body, an under-regeneration-treatment-solution inflow port, an under-regeneration-treatment-solution discharge port and an under-regeneration-treatment-solution circulation driving source. The under-regeneration-treatment-solution circulation channel main body is capable of containing one part of the oxalate treatment solution in the treatment solution regeneration bath, and has two end portions. The under-regeneration-treatment-solution inflow port is formed at one of the end portions of the under-regeneration-treatment-solution circulation channel main body, and allows the oxalate treatment solution in the treatment solution regeneration bath to flow into the under-regeneration-treatment-solution circulation channel main body. The under-regeneration-treatment-solution discharge port is formed at the other end portion of the under-regeneration-treatment-solution circulation channel main body, and discharges the oxalate treatment solution in the under-regeneration-treatment-solution circulation channel main body into the treatment solution regeneration bath. The under-regeneration-treatment-solution circulation driving source causes the oxalate treatment solution in the under-regeneration-treatment-solution circulation channel main body to move from the under-regeneration-treatment-solution inflow port to the under-regeneration-treatment-solution discharge port. At least one of the light source members is disposed between the under-regeneration-treatment-solution inflow port and the under-regeneration-treatment-solution discharge port.

By means of the under-regeneration-treatment-solution circulation channel, the oxalate treatment solution in the treatment solution regeneration bath repeatedly flows from the under-regeneration-treatment-solution discharge port toward the under-regeneration-treatment-solution inflow port. Because a light source member is disposed between the under-regeneration-treatment-solution discharge port and the under-regeneration-treatment-solution inflow port, a larger amount of the oxalate treatment solution is irradiated with light. As a result, the oxalate treatment solution can be subjected to regeneration treatment more efficiently.

Preferably, a bottom face of the treatment solution regeneration bath is inclined.

As described above, when light is radiated to the chemical treatment solution, insoluble iron (II) oxalate is generated. The iron (II) oxalate forms precipitate and settles inside the treatment solution regeneration bath. If the bottom face of the treatment solution regeneration bath is inclined, the precipitate accumulates at a lower location of the inclined bottom face. In this case, it is easy to recover the precipitate.

The treatment solution regeneration bath may be partitioned into a light irradiation chamber and a sedimentation chamber by a partition member. The partition member has an opening portion that connects the light irradiation chamber and the sedimentation chamber. In this case, the one or more light source members are disposed in the light irradiation chamber.

If the treatment solution regeneration bath is partitioned into a light irradiation chamber and a sedimentation chamber, light irradiation and removal of precipitate can be performed in separate compartments. In this case, removal of the precipitate can be performed more efficiently.

Preferably, the bottom face of the light irradiation chamber becomes lower in the direction from the light irradiation chamber toward the sedimentation chamber.

In a case where the bottom face of the light irradiation chamber becomes lower in the direction from the light irradiation chamber toward the sedimentation chamber, after precipitate that is generated in the light irradiation chamber settles on the bottom face of the light irradiation chamber, the precipitate moves under its own weight to the sedimentation chamber. In this case, removal of the precipitate can be performed more efficiently.

Preferably, the treatment solution regeneration bath further includes a current direction changing member. The current direction changing member is disposed so as to be immersible in the oxalate treatment solution in the treatment solution regeneration bath, and changes a direction of a flow of the oxalate treatment solution in the treatment solution regeneration bath.

If the treatment solution regeneration bath includes a current direction changing member, the directions of flows of the oxalate treatment solution in the treatment solution regeneration bath need not be uniformly aligned in a fixed direction, and a turbulent flow can easily be generated. If a turbulent flow is generated, the amount of oxalate treatment solution to be irradiated with light increases. Therefore, the oxalate treatment solution can be subjected to regeneration treatment more efficiently.

Preferably, the light radiation apparatus is an ultraviolet radiation apparatus.

By radiating light including a wavelength in the ultraviolet range by means of an ultraviolet radiation apparatus, the oxalate treatment solution can be regenerated more efficiently. The term "wavelength in the ultraviolet range" refers to a wavelength in the range of 10 to 400 nm.

The present embodiment will be described in detail below with reference to the drawings. The same reference symbols will be used throughout the drawings to refer to the same or like parts, and description thereof will not be repeated.

FIRST EMBODIMENT

[Method for Producing Chemically Treated Alloy Material]

A method for producing a chemically treated alloy material of the present embodiment includes a chemical treatment step and a treatment solution regeneration step. In the chemical treatment step, an alloy material is immersed in an oxalate treatment solution containing oxalate ions and fluorine ions to perform a chemical treatment. In the treatment solution regeneration step, light is radiated to the oxalate treatment solution during the chemical treatment and/or the oxalate treatment solution after the chemical treatment. The method for producing a chemically treated alloy material of the present embodiment uses, for example, the following chemical treatment solution regeneration apparatus.

[Chemical Treatment Solution Regeneration Apparatus]

Figure 3:
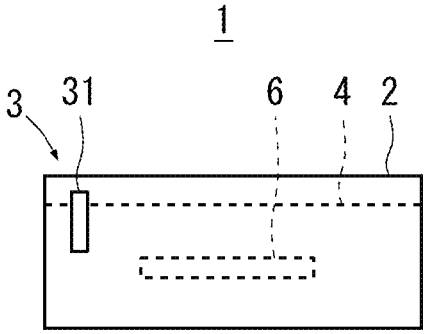
FIG. 3 is a schematic diagram of one example of a chemical treatment solution regeneration apparatus that is used in a method for producing a chemically treated alloy material according to the present embodiment.

FIG. 3 is a schematic diagram of one example of a chemical treatment solution regeneration apparatus 1 that is used in the method for producing a chemically treated alloy material according to the present embodiment. Referring to FIG. 3, the chemical treatment solution regeneration apparatus 1 includes a treatment solution regeneration bath 2 and a light radiation apparatus 3.

[Treatment Solution Regeneration Bath]

Referring to FIG. 3, the treatment solution regeneration bath 2 is capable of containing an oxalate treatment solution 4 during chemical treatment of an alloy material 6 or after chemical treatment of the alloy material 6. In FIG. 3, the treatment solution regeneration bath 2 is a casing. The top face of the treatment solution regeneration bath 2 may be open, or a top plate may be provided at the top face. At least one part of a top plate or a side face may be a member having translucency. The shape of the treatment solution regeneration bath 2 is not particularly limited as long as the treatment solution regeneration bath 2 is capable of containing the oxalate treatment solution 4 during chemical treatment or after chemical treatment of the alloy material 6. The shape of the treatment solution regeneration bath 2 may be a rectangular parallelepiped shape, a cubic shape or a pipe shape.

The oxalate treatment solution 4 which the treatment solution regeneration bath 2 contains includes oxalate ions and fluorine ions. As described later, the alloy material 6 may be immersed in the treatment solution regeneration bath 2, and regeneration of the oxalate treatment solution 4 in the treatment solution regeneration bath 2 and chemical treatment of the alloy material 6 may be performed at the same time. That is, the chemical treatment solution regeneration apparatus 1 may function as a chemical treatment apparatus for performing chemical treatment of the alloy material 6. In this case, the treatment solution regeneration bath 2 contains the oxalate treatment solution 4 during chemical treatment of the alloy material 6. In a case where chemical treatment is not to be performed in the treatment solution regeneration bath 2, the treatment solution regeneration bath 2 contains the oxalate treatment solution 4 after chemical treatment of the alloy material 6. The oxalate treatment solution 4 which the treatment solution regeneration bath 2 contains may be a mixture of the oxalate treatment solution 4 during chemical treatment of the alloy material 6 and the oxalate treatment solution 4 after chemical treatment of the alloy material 6. Further, as described later, in the case of performing a chemical treatment in the treatment solution regeneration bath 2, in addition to the oxalate treatment solution 4, the treatment solution regeneration bath 2 is also capable of containing the alloy material 6 that is the object of the chemical treatment.

[Light Radiation Apparatus]

The light radiation apparatus 3 includes a light source member 31 and an unshown power supply apparatus. At least one part of the light source member 31 is disposed inside the treatment solution regeneration bath 2 or in the vicinity of the outside of the treatment solution regeneration bath 2. The light source member 31 radiates light at the oxalate treatment solution 4. The light radiation apparatus 3 radiates light at the oxalate treatment solution 4 during chemical treatment or after chemical treatment to thereby regenerate the oxalate treatment solution 4.

The light radiation apparatus 3 is disposed in a manner so that the light radiation apparatus 3 is capable of radiating light at the oxalate treatment solution 4 in the treatment solution regeneration bath 2. The light source member 31 of the light radiation apparatus 3 may be disposed inside the treatment solution regeneration bath 2, as illustrated in FIG. 3, or may be disposed on the outside of the treatment solution regeneration bath 2. In a case where the light source member 31 is disposed inside the treatment solution regeneration bath 2, although the light source member 31 may be fixed without being immersed in the oxalate treatment solution 4, it is preferable that the light source member 31 is disposed in a manner in which at least one part thereof is immersible in the oxalate treatment solution 4 in the treatment solution regeneration bath 2, and a configuration in which all of the light source member 31 is immersed in the oxalate treatment solution 4 is more preferable.

The light radiated from the light source member 31 is attenuated when propagating through the atmosphere or through a member having translucency. However, if at least one part of the light source member 31 is immersed in the oxalate treatment solution 4 in the treatment solution regeneration bath 2, the distance between the light source and the oxalate treatment solution 4 is shortened. Therefore, stronger light can be radiated to the oxalate treatment solution 4. As a result, the oxalate treatment solution 4 can be subjected to regeneration treatment more efficiently.

A method for immersing the light source member 31 in the oxalate treatment solution 4 is not particularly limited.

For example, the light source member 31 may be fixed, and a predetermined amount of the oxalate treatment solution 4 may be filled into the treatment solution regeneration bath 2 so as to immerse at least one part of the light source member 31 in the oxalate treatment solution 4. Further, for example, the light radiation apparatus 3 may also include a driving source that moves the light source member 31 in the vertical direction and/or horizontal direction, and by moving the light source member 31 by means of the driving source, the light source member 31 may be immersed in the oxalate treatment solution 4 that was already filled in the treatment solution regeneration bath 2.

In a case where the light source member 31 is fixed without being immersed in the oxalate treatment solution 4, the light source member 31 may be disposed, for example, at a position in the treatment solution regeneration bath 2 that is a position above the oxalate treatment solution 4. Specifically, in a case where a top plate is attached to the treatment solution regeneration bath 2, the light source member 31 may be attached to the surface on the oxalate treatment solution 4 side of the top plate. In a case where a top plate is not attached to the treatment solution regeneration bath 2, the light source member 31 may be disposed at a position above the oxalate treatment solution 4 that is a position on the inner side of a side face of the treatment solution regeneration bath 2.

The number, size and shape of the light source members 31 are not particularly limited. The number of the light source members 31 may be one, as illustrated in FIG. 3, or may be more than one.

A method for producing a chemically treated alloy material according to the present embodiment using, for example, the aforementioned chemical treatment solution regeneration apparatus 1 will now be described.

[Chemical Treatment Step]

In the chemical treatment step, the alloy material 6 is immersed in the oxalate treatment solution 4 containing oxalate ions and fluorine ions to perform a chemical treatment. First, the oxalate treatment solution 4 is prepared and inserted into the treatment solution regeneration bath 2.

[Oxalate Treatment Solution]

The oxalate treatment solution 4 contains oxalate ions and fluorine ions. The oxalate treatment solution 4 is produced by dissolving oxalic acid or a salt having an oxalate ion as an anion, and a salt having a fluorine ion as an anion in a solvent. Examples of a salt having an oxalate ion as an anion include one or two or more types selected from the group consisting of sodium oxalate, ammonium oxalate, potassium oxalate and iron (III) oxalate. Examples of a salt having a fluorine ion as an anion include one or two or more types selected from the group consisting of sodium bifluoride, sodium fluoride, ammonium fluoride, potassium fluoride, hydrogen fluoride, hydrofluoric acid and nitrogen fluoride. The solvent may be, for example, water or a mixed solution of water and an organic solvent. The organic solvent is, for example, an organic solvent that is compatible with water.

The oxalate ion content of the oxalate treatment solution 4 is, for example, 1.0 to 50 g/L. A lower limit of the oxalate ion content of the oxalate treatment solution 4 is preferably 5.0 g/L. An upper limit of the oxalate ion content of the oxalate treatment solution 4 is preferably 30 g/L. The fluorine ion content of the oxalate treatment solution 4 is, for example, 0.1 to 10 g/L. A lower limit of the fluorine ion content of the oxalate treatment solution 4 is preferably 1.0 g/L. An upper limit of the fluorine ion content of the oxalate treatment solution 4 is preferably 5.0 g/L. Next, the alloy material 6 is immersed in the oxalate treatment solution 4.

As mentioned above, the oxalate treatment solution 4 contains oxalate ions, fluorine ions and a solvent. The oxalate treatment solution 4 may also contain other components. Preferably, the oxalate treatment solution 4 also contains an oxidizing agent. The oxidizing agent is, for example, nitrate ions. An oxidation reaction of hydrogen is promoted by nitrate ions. The oxidized hydrogen disperses in the oxalate treatment solution 4 as water. Nitrate ions can be contained in the oxalate treatment solution 4 by dissolving nitric acid or a salt having a nitrate ion as an anion in the oxalate treatment solution 4. Examples of a salt having a nitrate ion as an anion include one or two or more types selected from the group consisting of ammonium nitrate, potassium nitrate, calcium nitrate, iron nitrate, copper nitrate and sodium nitrate. In addition, the oxidizing agent may contain one or two or more types of substance selected from the group consisting of permanganate and peroxide. The content of the oxidizing agent in the oxalate treatment solution 4 is, for example, 0.1 to 20 g/L. An upper limit of the content of the oxidizing agent in the oxalate treatment solution 4 is preferably 10 g/L.

Preferably, the oxalate treatment solution 4 further contains an accelerating agent. The accelerating agent is, for example, thiosulfate ions. The thiosulfate ions react with dissolved oxygen in the oxalate treatment solution 4 and decompose into sulfuric acid. By this means, the amount of dissolved oxygen in the oxalate treatment solution 4 is reduced and the chemical treatment is accelerated. Thiosulfate ions can be contained in the oxalate treatment solution 4 by dissolving a salt having a thiosulfate ion as an anion in the oxalate treatment solution 4. Examples of a salt having a thiosulfate ion as an anion include one or two or more types selected from the group consisting of sodium thiosulfate, ammonium thiosulfate, potassium thiosulfate and calcium thiosulfate. The content of the accelerating agent in the oxalate treatment solution 4 is, for example, 1.0 to 50 g/L. A lower limit of the content of the accelerating agent in the oxalate treatment solution 4 is preferably 10 g/L. An upper limit of the content of the accelerating agent in the oxalate treatment solution 4 is preferably 40 g/L.

The chemical treatment is a well-known chemical treatment. The temperature and time period of the chemical treatment can be appropriately set. For example, the temperature of the chemical treatment is within the range of 40 to 100° C. A lower limit of the temperature of the chemical treatment is preferably 80° C. An upper limit of the temperature of the chemical treatment is preferably 95° C. For example, the time period of the chemical treatment is within the range of 1 to 200 minutes. A lower limit of the time period of the chemical treatment is preferably five minutes. An upper limit of the time period of the chemical treatment is preferably 20 minutes. The inside of the treatment solution regeneration bath 2 may be stirred during the chemical treatment or need not be stirred. The temperature of the chemical treatment may be adjusted by heating the treatment solution regeneration bath 2, or may be adjusted by immersing a heat source inside the treatment solution regeneration bath 2. The temperature of the chemical treatment may be adjusted by adding the oxalate treatment solution 4 that was heated using an unshown heating apparatus into the treatment solution regeneration bath 2.

[Treatment Solution Regeneration Step]

In the treatment solution regeneration step, the light radiation apparatus 3 is used to radiate light at the oxalate treatment solution 4 during chemical treatment and/or the oxalate treatment solution 4 after chemical treatment. The oxalate treatment solution 4 in the treatment solution regeneration bath 2 contains iron ions, oxalate ions and fluorine ions. When light is radiated to the oxalate treatment solution 4, iron ions are reduced and fluorine ions are released. By this means, the etching action of fluorine ions is restored. In addition, when light is radiated to the oxalate treatment solution 4, formation of iron (II) oxalate is accelerated. The iron (II) oxalate formed as the result of light irradiation precipitates. Thus, the iron ion content of the oxalate treatment solution 4 decreases. When the iron ion content decreases, it becomes difficult to form complexes between iron ions and fluorine ions. Therefore, the action of the fluorine ions is more actively maintained. As a result, a decrease in the chemical treatability can be suppressed even in a case where chemical treatment is repeatedly performed.

In the case of the production method including the above steps, a decrease in chemical treatability can be suppressed even in a case where chemical treatment is repeatedly performed.

[Oxalate Ion Addition Step]

The production method described above may also include an oxalate ion addition step. In the treatment solution regeneration step, oxalate ions are consumed as the iron ion content of the oxalate treatment solution 4 decreases. If the production method includes a step of adding oxalate ions, consumed oxalate ions are replenished. Addition of oxalate ions is performed by dissolving oxalic acid or a salt having an oxalate ion as an anion in the oxalate treatment solution 4. Alternatively, the addition of oxalate ions is performed by adding a solution in which oxalate ions were dissolved to the oxalate treatment solution 4. Examples of salts having an oxalate ion as an anion include one or two or more types of salt selected from the group consisting of sodium oxalate, ammonium oxalate, potassium oxalate and iron (III) oxalate. By this means, the oxalate ion content of the oxalate treatment solution 4 increases. As a result, it becomes easy for oxalate ions to react with iron (divalent iron ions) that dissolved on the surface of the alloy material 6, and the chemical treatment is accelerated. The concentration of the added oxalate ions can be appropriately set.

The time point at which to perform the oxalate ion addition step is not particularly limited. The oxalate ion addition step may be performed before the chemical treatment step, may be performed during the chemical treatment step, or may be performed after the chemical treatment. The oxalate ion addition step may be performed at a time point that is after the chemical treatment and before the treatment solution regeneration step, or may be performed during the treatment solution regeneration step, or may be performed after the treatment solution regeneration step.

[Other Steps]

The production method described above may also include a preparation step of preparing the alloy material 6 before the chemical treatment step. The term "preparation" refers to, for example, shotblasting, pickling or degreasing. A lubrication coating may be formed on the surface of the chemically treated alloy material produced by the above described production method. The lubrication coating is, for example, metallic soap.

[Wavelengths of Light]

In a case where wavelengths of the light in the treatment solution regeneration step are short wavelengths of high intensity, the decomposition reaction of iron (III) oxalate to iron (II) oxalate is further accelerated. Therefore, preferably the wavelengths of the light include a wavelength in the ultraviolet range. If the wavelengths of the light include a wavelength in the ultraviolet range, an etching action of fluorine ions can be restored more efficiently, and the iron ion content of the oxalate treatment solution 4 can be reduced more efficiently. Here, the term "wavelength in the ultraviolet range" refers to a wavelength in the range of 10 to 400 nm.

[Alloy Material]

The shape of the alloy material 6 is not particularly limited as long as the shape is such that an oxalate coating can be formed. The shape of the alloy material 6 is, for example, the shape of a plate, a pipe, a bar, a wire rod, a sphere, die steel, another alloy material for construction or a machine construction component, a gear, a connecting rod, a crankshaft, a piston or another automobile component. The method for producing a chemically treated alloy material of the present embodiment can be favorably applied to a case where the shape of the alloy material 6 is a pipe shape.

The chemical composition of the alloy material 6 contains Fe. It suffices that the chemical composition of the alloy material 6 contains Fe. That is, the alloy material 6 may be a steel material that contains 50% or more of Fe. In this case, the alloy material 6 may contain 10.5% or more of Cr. An oxide film that has high corrosion resistance is formed on the surface of the alloy material 6 that contains 10.5% or more of Cr. According to the method for producing a chemically treated alloy material of the present embodiment, the action of fluorine ions is actively maintained. Therefore, a chemically treated alloy material can be produced even when using the alloy material 6 having an oxide film formed on the surface. The method for producing a chemically treated alloy material of the present embodiment can be favorably used for the alloy material 6 that contains 10.5% or more of Cr. In addition, the alloy material 6 may be, for example, an Ni-based alloy or an Ni—Cr—Fe alloy. The method for producing a chemically treated alloy material of the present embodiment can also be favorably used for the alloy material 6 in which the total content of Cr and/or Ni is more than 50% (that is, the alloy material 6 in which the Fe content is less than 50%).

SECOND EMBODIMENT

[Method for Producing Chemically Treated Alloy Material]

Preferably, in the aforementioned treatment solution regeneration step, light is radiated to the oxalate treatment solution 4 while causing the oxalate treatment solution 4 in the treatment solution regeneration bath 2 to flow. By causing the oxalate treatment solution 4 in the treatment solution regeneration bath 2 to flow, the amount of the oxalate treatment solution 4 to be irradiated with light increases. As a result, the oxalate treatment solution 4 can be subjected to regeneration treatment more efficiently, and hence a decrease in chemical treatability can be suppressed more efficiently. For example, if the chemical treatment solution regeneration apparatus 1 that is described hereunder is used, the treatment solution regeneration step can be executed while causing the oxalate treatment solution 4 to flow.

[Chemical Treatment Solution Regeneration Apparatus]

Preferably, the chemical treatment solution regeneration apparatus 1 further includes a flow mechanism that causes the oxalate treatment solution 4 in the treatment solution regeneration bath 2 to flow.

[Flow Mechanism]

Figure 4:
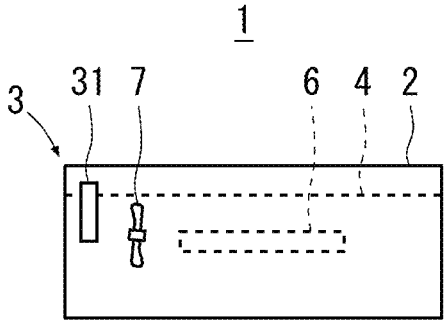
FIG. 4 is a schematic diagram of a chemical treatment solution regeneration apparatus according to another embodiment that is different from FIG. 3.

The flow mechanism is not particularly limited as long as the flow mechanism is a mechanism capable of causing the oxalate treatment solution 4 in the treatment solution regeneration bath 2 to flow. FIG. 4 is a schematic diagram of a chemical treatment solution regeneration apparatus 1 according to another embodiment that is different from FIG. 3. Referring to FIG. 4, in addition to the treatment solution regeneration bath 2 and the light radiation apparatus 3, the chemical treatment solution regeneration apparatus 1 includes a flow mechanism 7. For example, as illustrated in FIG. 4, the flow mechanism 7 is an apparatus that is attached to a rotary shaft, and generates a flow in the rotary shaft direction by rotation of a blade having a helicoidal surface around the rotary shaft. The flow mechanism 7 is, for example, a screw or a propeller.

However, the flow mechanism 7 may be another kind of mechanism. The flow mechanism 7, for example, may be a mechanism that causes the oxalate treatment solution 4 to circulate. The flow mechanism 7 for example, may be a mechanism that utilizes a pump to pump up some of the oxalate treatment solution 4 in the treatment solution regeneration bath 2, and returns the pumped-up oxalate treatment solution 4 into the treatment solution regeneration bath 2 utilizing a height difference. The flow mechanism 7, for example, may be a mechanism that includes a heating apparatus inside the treatment solution regeneration bath 2, and causes the oxalate treatment solution 4 which was heated by the heating apparatus to flow by convection.

The number and arrangement of flow mechanisms 7 is not particularly limited. The number of flow mechanisms 7 may be one or may be more than one. A direction in which the oxalate treatment solution 4 is caused to flow by the flow mechanism 7 may be the horizontal direction, may be a perpendicular direction from above to below, may be a perpendicular direction from below to above, or may be a direction that is inclined with respect to the horizontal direction. The oxalate treatment solution 4 may be caused to flow in one direction by the flow mechanism 7, or flows of the oxalate treatment solution 4 in different directions may be generated by flow mechanisms 7 that are oriented in different directions. In short, it suffices that the amount of the oxalate treatment solution 4 to be irradiated with light from the light source member 31 can be increased. Accordingly, directions in which the oxalate treatment solution 4 is caused to flow by the flow mechanism 7 include at least a direction toward the light source member 31.

A method for producing a chemically treated alloy material that uses, for example, the chemical treatment solution regeneration apparatus 1 described above will now be described.

[Chemical Treatment Step]

The chemical treatment step is the same as in the first embodiment.

[Treatment Solution Regeneration Step]

In a case where the chemical treatment solution regeneration apparatus 1 includes the flow mechanism 7, during the treatment solution regeneration step, the oxalate treatment solution 4 in the treatment solution regeneration bath 2 is caused to flow by the flow mechanism 7. The greater that the amount of the oxalate treatment solution 4 that is caused to flow is, the more that the amount of the oxalate treatment solution 4 to be irradiated with light can be increased. Therefore, the oxalate treatment solution 4 can be subjected to regeneration treatment more efficiently. For example, by increasing the speed at which the oxalate treatment solution 4 is caused to flow by the flow mechanism 7, a greater amount of the oxalate treatment solution 4 can be irradiated with light. In addition, by increasing the amount of the oxalate treatment solution 4 that flows at one time by providing a plurality of the flow mechanisms 7 and causing the plurality of the flow mechanisms 7 to operate simultaneously, a greater amount of the oxalate treatment solution 4 can be irradiated with light.

By means of the method described above, in the treatment solution regeneration step, light can be radiated to the oxalate treatment solution 4 while causing the oxalate treatment solution 4 in the treatment solution regeneration bath 2 to flow.

The method for producing a chemically treated alloy material of the present disclosure can also be implemented by an apparatus other than the apparatuses illustrated in FIG. 3 and FIG. 4. Hereunder, examples of the chemical treatment solution regeneration apparatus 1 that are capable of implementing the method for producing a chemically treated alloy material of the present disclosure are described.

THIRD EMBODIMENT

Figure 5:
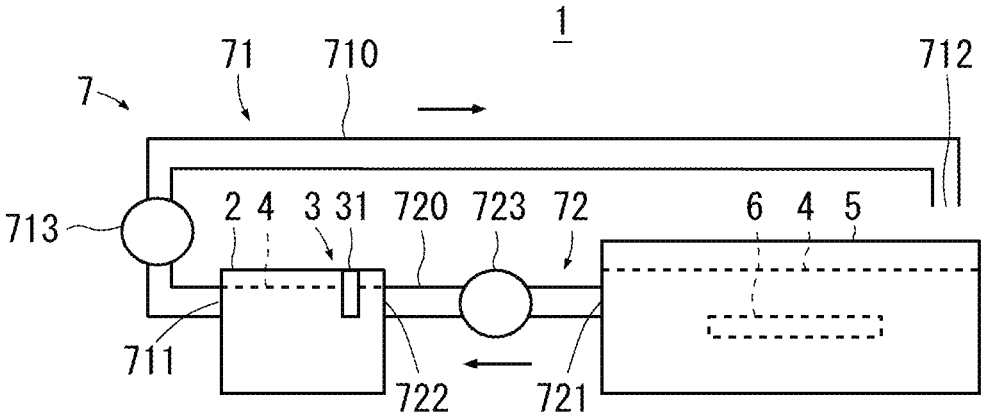
FIG. 5 is a schematic diagram of a chemical treatment solution regeneration apparatus according to another embodiment that is different from FIG. 3 and FIG. 4.

The chemical treatment solution regeneration apparatus 1 may have a chemical treatment bath 5 in addition to the treatment solution regeneration bath 2. In such case, chemical treatment of the alloy material 6 and regeneration treatment of the oxalate treatment solution 4 are performed in separate baths. In a case where the chemical treatment solution regeneration apparatus 1 includes the chemical treatment bath 5 that is separate from the treatment solution regeneration bath 2, the flow mechanism 7 may have a first liquid supply channel and a second liquid supply channel. FIG. 5 is a schematic diagram of the chemical treatment solution regeneration apparatus 1 according to another embodiment that is different to the embodiments illustrated in FIG. 3 and FIG. 4. The arrows in FIG. 5 indicate the direction in which the oxalate treatment solution 4 circulates. Referring to FIG. 5, the chemical treatment solution regeneration apparatus 1 includes the treatment solution regeneration bath 2, the light radiation apparatus 3, the chemical treatment bath 5 and the flow mechanism 7. The flow mechanism 7 includes a first liquid supply channel 71 that conveys the oxalate treatment solution 4 in the treatment solution regeneration bath 2 to the chemical treatment bath 5, and a second liquid supply channel 72 that conveys the oxalate treatment solution 4 in the chemical treatment bath 5 to the treatment solution regeneration bath 2. The chemical treatment solution regeneration apparatus 1 circulates the oxalate treatment solution 4 between the chemical treatment bath 5 and the treatment solution regeneration bath 2 by means of the first liquid supply channel 71 and the second liquid supply channel 72. By this means, even in the case of performing chemical treatments in succession, a decrease in chemical treatability can be suppressed.

[Chemical Treatment Bath]

The chemical treatment bath 5 is capable of containing the oxalate treatment solution 4 after being irradiated with light by the light radiation apparatus 3 in the treatment solution regeneration bath 2. In the chemical treatment bath 5, a chemical treatment in which the alloy material 6 is immersed in the oxalate treatment solution 4 contained therein can be performed. In FIG. 5, the chemical treatment bath 5 has a rectangular parallelepiped-shaped casing. The top face of the chemical treatment bath 5 may be open, or a top plate may be provided at the top face. The shape of the chemical treatment bath 5 may be a rectangular parallelepiped shape, a cubic shape, or the shape of a casing that has a circular bottom face like a bucket. Further, the number of chemical treatment baths 5 is not particularly limited.

[First Liquid Supply Channel]

The first liquid supply channel 71 connects the treatment solution regeneration bath 2 and the chemical treatment bath 5, and conveys the oxalate treatment solution 4 from the treatment solution regeneration bath 2 to the chemical treatment bath 5. The first liquid supply channel 71 includes a first liquid supply channel main body 710, a treatment-solution-regeneration-bath-side inflow port 711 that is formed at one of the end portions of the first liquid supply channel main body 710, and a chemical-treatment-bath-side discharge port 712 that is formed at the other end portion of the first liquid supply channel main body 710. The first liquid supply channel 71 may further include a first liquid supply channel driving source 713.

[First Liquid Supply Channel Main Body]

The shape of the first liquid supply channel main body 710 is, for example, tubular. A filter for collecting precipitate, or a valve that inhibits a back flow of the oxalate treatment solution 4 may be provided inside the first liquid supply channel main body 710.

[Treatment-Solution-Regeneration-Bath-Side Inflow Port]

The treatment-solution-regeneration-bath-side inflow port 711 is formed at an end portion on the treatment solution regeneration bath 2 side of the first liquid supply channel main body 710. The treatment-solution-regeneration-bath-side inflow port 711 allows the oxalate treatment solution 4 in the treatment solution regeneration bath 2 to flow into the first liquid supply channel main body 710. Preferably, the treatment-solution-regeneration-bath-side inflow port 711 is disposed further downstream than the center position of the treatment solution regeneration bath 2. A filter for inhibiting the flow of precipitate or other foreign substances into the first liquid supply channel main body 710 may be provided in the treatment-solution-regeneration-bath-side inflow port 711.

[Chemical-Treatment-Bath-Side Discharge Port]

The chemical-treatment-bath-side discharge port 712 is formed at an end portion on the chemical treatment bath 5 side of the first liquid supply channel main body 710. The chemical-treatment-bath-side discharge port 712 discharges the oxalate treatment solution 4 in the first liquid supply channel main body 710 into the chemical treatment bath 5. Preferably, the chemical-treatment-bath-side discharge port 712 is disposed further upstream than the center position of the chemical treatment bath 5. In this case, the oxalate treatment solution 4 in the chemical treatment bath 5 can be caused to circulate more efficiently.

[First Liquid Supply Channel Driving Source]

The first liquid supply channel driving source 713 causes the oxalate treatment solution 4 in the first liquid supply channel main body 710 to move from the treatment-solution-regeneration-bath-side inflow port 711 to the chemical-treatment-bath-side discharge port 712. The first liquid supply channel driving source 713 is not particularly limited as long as the first liquid supply channel driving source 713 is capable of moving the oxalate treatment solution 4. The first liquid supply channel driving source 713 is, for example, a pump.

[Second Liquid Supply Channel]

The second liquid supply channel 72 connects the chemical treatment bath 5 and the treatment solution regeneration bath 2, and conveys the oxalate treatment solution 4 from the chemical treatment bath 5 to the treatment solution regeneration bath 2. The second liquid supply channel 72 includes a second liquid supply channel main body 720, a chemical-treatment-bath-side inflow port 721 that is formed at one of the end portions of the second liquid supply channel main body 720, and a treatment-solution-regeneration-bath-side discharge port 722 that is formed at the other end portion of the second liquid supply channel main body 720. The second liquid supply channel 72 may further include a second liquid supply channel driving source 723.

[Second Liquid Supply Channel Main Body]

The shape of the second liquid supply channel main body 720 is, for example, tubular. A filter for collecting precipitate or other foreign substances, or a valve that inhibits a back flow of the oxalate treatment solution 4 may be provided inside the second liquid supply channel main body 720.

[Chemical-Treatment-Bath-Side Inflow Port]

The chemical-treatment-bath-side inflow port 721 is formed at an end portion on the chemical treatment bath 5 side of the second liquid supply channel main body 720. The chemical-treatment-bath-side inflow port 721 allows the oxalate treatment solution 4 in the chemical treatment bath 5 to flow into the second liquid supply channel main body 720. Preferably, the chemical-treatment-bath-side inflow port 721 is disposed further downstream than the center position of the chemical treatment bath 5. In this case, the oxalate treatment solution 4 in the chemical treatment bath 5 can be caused to circulate more efficiently.

[Treatment-Solution-Regeneration-Bath-Side Discharge Port]

The treatment-solution-regeneration-bath-side discharge port 722 is formed at an end portion on the treatment solution regeneration bath 2 side of the second liquid supply channel main body 720. The treatment-solution-regeneration-bath-side discharge port 722 discharges the oxalate treatment solution 4 in the second liquid supply channel main body 720 into the treatment solution regeneration bath 2. Preferably, the treatment-solution-regeneration-bath-side discharge port 722 is disposed further upstream than the center position of the treatment solution regeneration bath 2.

[Second Liquid Supply Channel Driving Source]

The second liquid supply channel driving source 723 causes the oxalate treatment solution 4 in the second liquid supply channel main body 720 to move from the chemical-treatment-bath-side inflow port 721 to the treatment-solution-regeneration-bath-side discharge port 722. The second liquid supply channel driving source 723 is not particularly limited as long as the second liquid supply channel driving source 723 is capable of moving the oxalate treatment solution 4. The second liquid supply channel driving source 723 is, for example, a pump.

In a case where the chemical treatment solution regeneration apparatus 1 includes a plurality of the chemical treatment baths 5, the first liquid supply channel 71 may be connected to each of the plurality of chemical treatment baths 5, and may convey the oxalate treatment solution 4 in the treatment solution regeneration bath 2 to each of the chemical treatment baths 5. Further, as described later, a single first liquid supply channel 71 that is connected to the treatment solution regeneration bath 2 may branch at a position along the single first liquid supply channel 71 and convey the oxalate treatment solution 4 to each of the chemical treatment baths 5. The same applies with respect to the second liquid supply channel 72. The second liquid supply channel 72 may be connected to each of the chemical treatment baths 5, and the oxalate treatment solution 4 from the respective chemical treatment baths 5 may be conveyed to the same treatment solution regeneration bath 2. A configuration may also be adopted in which second liquid supply channels 72 that are connected to the respective chemical treatment baths 5 merge at a partway position.

In FIG. 5, the first liquid supply channel driving source 713 is disposed on the first liquid supply channel 71, and the second liquid supply channel driving source 723 is disposed on the second liquid supply channel 72. However, the number and arrangement of the first liquid supply channel driving source 713 and the second liquid supply channel driving source 723 are not limited to the example illustrated in FIG. 5. For example, either one of the first liquid supply channel driving source 713 and the second liquid supply channel driving source 723 need not be provided. For example, in a case where a height difference is provided between the installation location of the chemical treatment bath 5 and the installation location of the treatment solution regeneration bath 2, and the oxalate treatment solution 4 is caused to flow by utilizing the height difference, the first liquid supply channel driving source 713 or the second liquid supply channel driving source 723 may be disposed only on the liquid supply channel which has the lowest place among the entire first liquid supply channel 71 or the entire second liquid supply channel 72.

The oxalate treatment solution 4 that was irradiated with light within the treatment solution regeneration bath 2 is conveyed by the first liquid supply channel 71 to the chemical treatment bath 5. Thus, in the chemical treatment bath 5, chemical treatment can be carried out utilizing the oxalate treatment solution 4 that underwent regeneration treatment. The oxalate treatment solution 4 which deteriorated inside the chemical treatment bath 5 is conveyed by the second liquid supply channel 72 to the treatment solution regeneration bath 2. Inside the treatment solution regeneration bath 2, the oxalate treatment solution 4 is regenerated by light irradiation. The oxalate treatment solution 4 that underwent the regeneration treatment is conveyed once more by the first liquid supply channel 71 to the chemical treatment bath 5. By causing the oxalate treatment solution 4 to circulate between the treatment solution regeneration bath 2 and the chemical treatment bath 5 in this manner, a decrease in chemical treatability can be suppressed even in the case of performing chemical treatments in succession.

Figure 6:
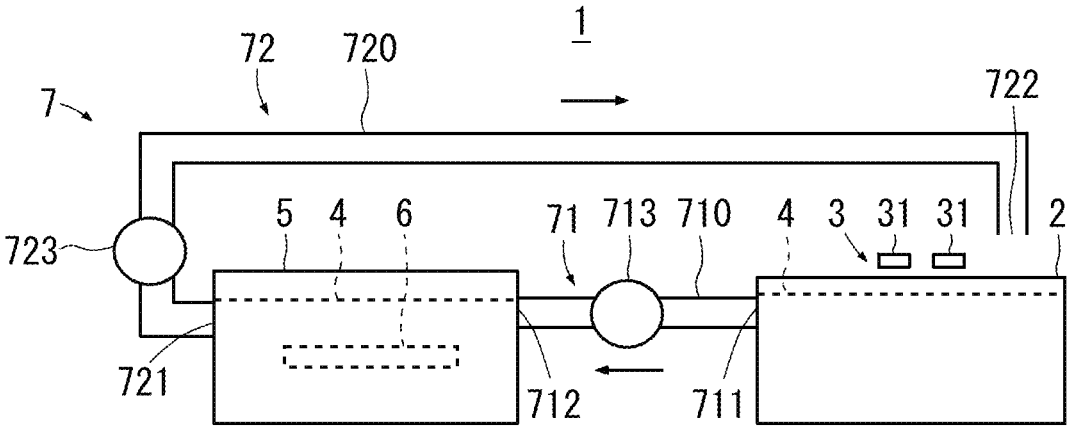
FIG. 6 is a schematic diagram of a chemical treatment solution regeneration apparatus according to another embodiment that is different from FIG. 3 to FIG. 5.

The arrangement of the treatment solution regeneration bath 2, the light radiation apparatus 3, the chemical treatment bath 5, the first liquid supply channel 71 and the second liquid supply channel 72 is not limited to the example illustrated in FIG. 5 as long as the arrangement of these components satisfies the aforementioned conditions. FIG. 6 is a schematic diagram of the chemical treatment solution regeneration apparatus 1 according to another embodiment that is different from FIG. 3 to FIG. 5. Although in FIG. 5 the light source member 31 of the light radiation apparatus 3 is disposed at a position such that one part thereof is immersed in the oxalate treatment solution 4 in the treatment solution regeneration bath 2, in FIG. 6 the light source member 31 is disposed in the vicinity of the outside of the treatment solution regeneration bath 2.

As described above, the method for producing a chemically treated alloy material of the present disclosure can also be carried out using the chemical treatment solution regeneration apparatus 1 that includes the chemical treatment bath 5, the first liquid supply channel 71 and the second liquid supply channel 72. In this case, in the treatment solution regeneration step, the oxalate treatment solution 4 is caused to circulate between the treatment solution regeneration bath 2 and the chemical treatment bath 5 using the first liquid supply channel 71 and the second liquid supply channel 72.

FOURTH EMBODIMENT

As described above, a plurality of the chemical treatment baths 5 may be provided. For example, the chemical treatment baths 5 may include a first chemical treatment bath 51 and a second chemical treatment bath 52. In addition, a discharge port switching mechanism and an inflow port switching mechanism may be used to switch between the oxalate treatment solutions 4 in the chemical treatment baths to be circulated. In this case, the oxalate treatment solutions 4 in the first chemical treatment bath 51 and the second chemical treatment bath 52 can be caused to circulate in an alternating manner.

Figure 7:
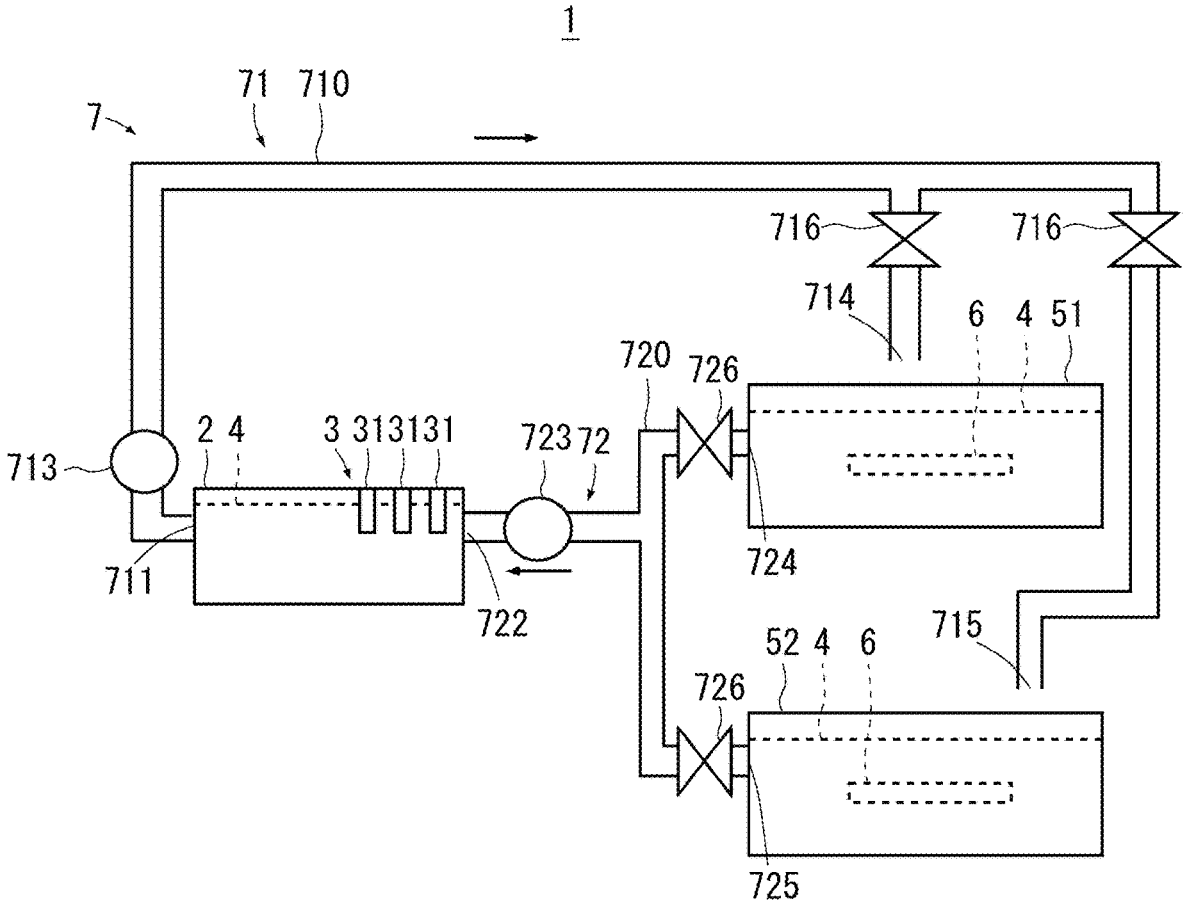
FIG. 7 is a schematic diagram of a chemical treatment solution regeneration apparatus according to another embodiment that is different from FIG. 3 to FIG. 6.

FIG. 7 is a schematic diagram of the chemical treatment solution regeneration apparatus 1 according to another embodiment that is different from FIG. 3 to FIG. 6. In a case where the chemical treatment baths 5 include the first chemical treatment bath 51 and the second chemical treatment bath 52, the first liquid supply channel main body 710 may include two end portions on the chemical treatment bath 5 side. A discharge port is formed at the two end portions on the chemical treatment bath 5 side of the first liquid supply channel main body 710. Specifically, the first liquid supply channel 71 includes the first liquid supply channel main body 710, a first chemical-treatment-bath-side discharge port 714 and a second chemical-treatment-bath-side discharge port 715. The first chemical-treatment-bath-side discharge port 714 is formed at one of the end portions on the chemical treatment bath 5 side of the first liquid supply channel main body 710, and discharges the oxalate treatment solution 4 in the first liquid supply channel main body 710 into the first chemical treatment bath 51. The second chemical-treatment-bath-side discharge port 715 is formed at the other end portion on the chemical treatment bath 5 side of the first liquid supply channel main body 710, and discharges the oxalate treatment solution 4 in the first liquid supply channel main body 710 into the second chemical treatment bath 52. The two end portions on the chemical treatment bath 5 side of the first liquid supply channel 71 may be formed in a manner in which the first liquid supply channel main body 710 branches at a partway position as illustrated in FIG. 7, or a configuration may be adopted in which two of the first liquid supply channels 71 are provided, and the two end portions are the end portions of the two first liquid supply channels 71, respectively.

In a case where the chemical treatment baths 5 include the first chemical treatment bath 51 and the second chemical treatment bath 52, the second liquid supply channel main body 720 may include two end portions on the chemical treatment bath 5 side. An inflow port is formed at each of the two end portions on the chemical treatment bath 5 side of the second liquid supply channel main body 720. Specifically, the second liquid supply channel 72 includes the second liquid supply channel main body 720, a first chemical-treatment-bath-side inflow port 724 and a second chemical-treatment-bath-side inflow port 725. The first chemical-treatment-bath-side inflow port 724 is formed at one of the end portions on the chemical treatment bath 5 side of the second liquid supply channel main body 720, and allows the oxalate treatment solution 4 in the first chemical treatment bath 51 to flow into the second liquid supply channel main body 720. The second chemical-treatment-bath-side inflow port 725 is formed at the other of the end portions on the chemical treatment bath 5 side of the second liquid supply channel main body 720, and allows the oxalate treatment solution 4 in the second chemical treatment bath 52 to flow into the second liquid supply channel main body 720. The two end portions of the second liquid supply channel 72 may be formed in a manner in which the second liquid supply channel main body 720 branches at a partway position as illustrated in FIG. 7, or a configuration may be adopted in which two of the second liquid supply channels 72 are provided, and the two end portions are the end portions of the two second liquid supply channels 72, respectively.

Referring to FIG. 7, preferably the flow mechanism 7 also includes a discharge port switching mechanism 716 and an inflow port switching mechanism 726. The discharge port switching mechanism 716 switches whether to cause the oxalate treatment solution 4 in the first liquid supply channel main body 710 to be discharged from the first chemical-treatment-bath-side discharge port 714 or from the second chemical-treatment-bath-side discharge port 715. The inflow port switching mechanism 726 switches whether to cause the oxalate treatment solution 4 to flow into the second liquid supply channel main body 720 from the first chemical-treatment-bath-side inflow port 724 or from the second chemical-treatment-bath-side inflow port 725.

The discharge port switching mechanism 716 and the inflow port switching mechanism 726 are not particularly limited as long as a flow of the oxalate treatment solution 4 can be switched. The discharge port switching mechanism 716 is, for example, a valve. Referring to FIG. 7, two valves are provided that are disposed on the first chemical treatment bath 51 side and on the second chemical treatment bath 52 side on the branched first liquid supply channel main body 710, respectively. The discharge port switching mechanism 716 may also be a pump. In this case, the first liquid supply channel driving source 713 (pump) is not required.

The inflow port switching mechanism 726 is, for example, a valve. Referring to FIG. 7, two valves are provided that are disposed on the first chemical treatment bath 51 side and on the second chemical treatment bath 52 side on the branched second liquid supply channel main body 720, respectively. The inflow port switching mechanism 726 may also be a pump. In this case, the second liquid supply channel driving source 723 (pump) is not required.

FIFTH EMBODIMENT

In the third and fourth embodiments, the chemical treatment solution regeneration apparatus 1 includes the chemical treatment bath 5, and the flow mechanism 7 causes the oxalate treatment solution 4 as a whole to circulate between the chemical treatment bath 5 and the treatment solution regeneration bath 2. On the other hand, the flow mechanism 7 causes the oxalate treatment solution 4 in the treatment solution regeneration bath 2 to circulate.

Figure 8:
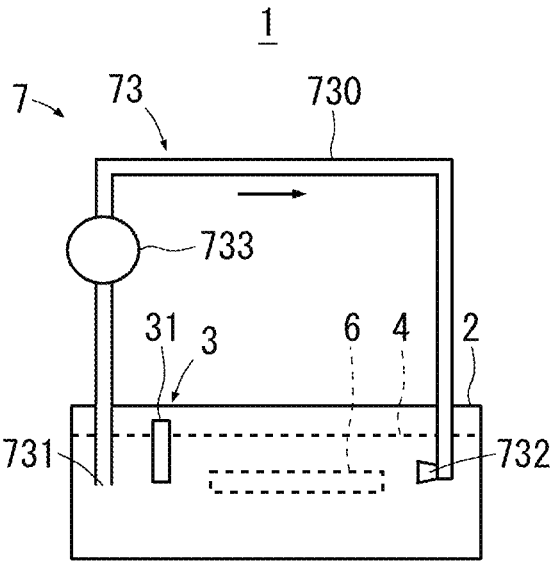
FIG. 8 is a schematic diagram of a chemical treatment solution regeneration apparatus according to another embodiment that is different from FIG. 3 to FIG. 7.

FIG. 8 is a schematic diagram of the chemical treatment solution regeneration apparatus 1 according to another embodiment that is different from FIG. 3 to FIG. 7. Referring to FIG. 8, the chemical treatment solution regeneration apparatus 1 includes the treatment solution regeneration bath 2, the light radiation apparatus 3 and the flow mechanism 7. The flow mechanism 7 includes an under-regeneration-treatment-solution circulation channel 73 that causes the oxalate treatment solution 4 within the treatment solution regeneration bath 2 to circulate.

[Under-Regeneration-Treatment-Solution Circulation Channel]

The under-regeneration-treatment-solution circulation channel 73 includes an under-regeneration-treatment-solution circulation channel main body 730, an under-regeneration-treatment-solution inflow port 731 and an under-regeneration-treatment-solution discharge port 732. At least one light source member 31 is disposed between the under-regeneration-treatment-solution inflow port 731 and the under-regeneration-treatment-solution discharge port 732. The under-regeneration-treatment-solution circulation channel 73 also includes an under-regeneration-treatment-solution circulation driving source 733.

By means of the under-regeneration-treatment-solution circulation channel 73, the oxalate treatment solution 4 in the treatment solution regeneration bath 2 is caused to repeatedly flow from the under-regeneration-treatment-solution discharge port 732 toward the under-regeneration-treatment-solution inflow port 731. Therefore, the occasions at which the oxalate treatment solution 4 is irradiated with light from the light source member 31 that is disposed between the under-regeneration-treatment-solution discharge port 732 and the under-regeneration-treatment-solution inflow port 731 increase. As a result, the oxalate treatment solution 4 can be subjected to regeneration treatment more efficiently.

[Under-Regeneration-Treatment-Solution Circulation Channel Main Body]

The shape of the under-regeneration-treatment-solution circulation channel main body 730 is not particularly limited. The shape of the under-regeneration-treatment-solution circulation channel main body 730 is, for example, tubular. A filter for collecting precipitate or other foreign substances, or a valve that inhibits a back flow of the oxalate treatment solution 4 may be provided in the under-regeneration-treatment-solution circulation channel main body 730.

[Under-Regeneration-Treatment-Solution Inflow Port]

The under-regeneration-treatment-solution inflow port 731 is formed at one of the end portions of the under-regeneration-treatment-solution circulation channel main body 730, and allows the oxalate treatment solution 4 in the treatment solution regeneration bath 2 to flow into the under-regeneration-treatment-solution circulation channel main body 730. A filter for inhibiting precipitate from flowing into the under-regeneration-treatment-solution circulation channel main body 730, or a valve that inhibits a back flow of the oxalate treatment solution 4 may be provided in the under-regeneration-treatment-solution inflow port 731.

[Under-Regeneration-Treatment-Solution Discharge Port]

The under-regeneration-treatment-solution discharge port 732 is formed at the other end portion of the under-regeneration-treatment-solution circulation channel main body 730, and discharges the oxalate treatment solution 4 that is in the under-regeneration-treatment-solution circulation channel main body 730. The under-regeneration-treatment-solution discharge port 732 may be disposed so as to be immersible in the oxalate treatment solution 4 in the treatment solution regeneration bath 2 as illustrated in FIG. 8, or a hole that penetrates a side face of the treatment solution regeneration bath 2 may be provided and the under-regeneration-treatment-solution discharge port 732 may be disposed in a manner in which the under-regeneration-treatment-solution discharge port 732 is connected to the hole, or the under-regeneration-treatment-solution discharge port 732 may be disposed above the treatment solution regeneration bath 2. As illustrated in FIG. 8, an ejection nozzle for increasing the discharge speed of the oxalate treatment solution 4 may be provided in the under-regeneration-treatment-solution discharge port 732.

[Under-Regeneration-Treatment-Solution Circulation Driving Source]

The under-regeneration-treatment-solution circulation driving source 733 causes the oxalate treatment solution 4 in the under-regeneration-treatment-solution circulation channel main body 730 to move from the under-regeneration-treatment-solution inflow port 731 to the under-regeneration-treatment-solution discharge port 732. The under-regeneration-treatment-solution circulation driving source 733 is, for example, a pump.

At least one light source member 31 is disposed between the under-regeneration-treatment-solution discharge port 732 and the under-regeneration-treatment-solution inflow port 731. In a case where a plurality of the light source members 31 are disposed, preferably all of the light source members 31 are disposed between the under-regeneration-treatment-solution discharge port 732 and the under-regeneration-treatment-solution inflow port 731. In this case, the amount of the oxalate treatment solution 4 to be irradiated with light while the oxalate treatment solution 4 flows from the under-regeneration-treatment-solution discharge port 732 to the under-regeneration-treatment-solution inflow port 731 increases.

The number of under-regeneration-treatment-solution circulation channels 73 is not particularly limited. One under-regeneration-treatment-solution circulation channel 73 may be provided as illustrated in FIG. 8, or a plurality of the under-regeneration-treatment-solution circulation channels 73 may be provided. In a case where a plurality of the under-regeneration-treatment-solution circulation channels 73 are provided, the direction in which the oxalate treatment solution 4 is circulated may be the same or different for each of the under-regeneration-treatment-solution circulation channels 73. In a case where a plurality of the under-regeneration-treatment-solution circulation channels 73 are provided, the respective under-regeneration-treatment-solution circulation channels 73 may operate simultaneously or may operate at different times from each other.

SIXTH EMBODIMENT

In a case where the flow mechanism 7 includes the under-regeneration-treatment-solution circulation channel 73 also, the chemical treatment solution regeneration apparatus 1 may have a configuration in which the chemical treatment bath 5 is provided in addition to the treatment solution regeneration bath 2, and chemical treatment of the alloy material 6 and regeneration treatment of the oxalate treatment solution 4 can be performed separately to each other. In this case, preferably the chemical treatment solution regeneration apparatus 1 includes the under-regeneration-treatment-solution circulation channel 73 which causes the oxalate treatment solution 4 in the treatment solution regeneration bath 2 to circulate, and the first liquid supply channel 71 and the second liquid supply channel 72 which cause the entire oxalate treatment solution 4 to circulate, including the oxalate treatment solution 4 in the chemical treatment bath 5.

Figure 9:
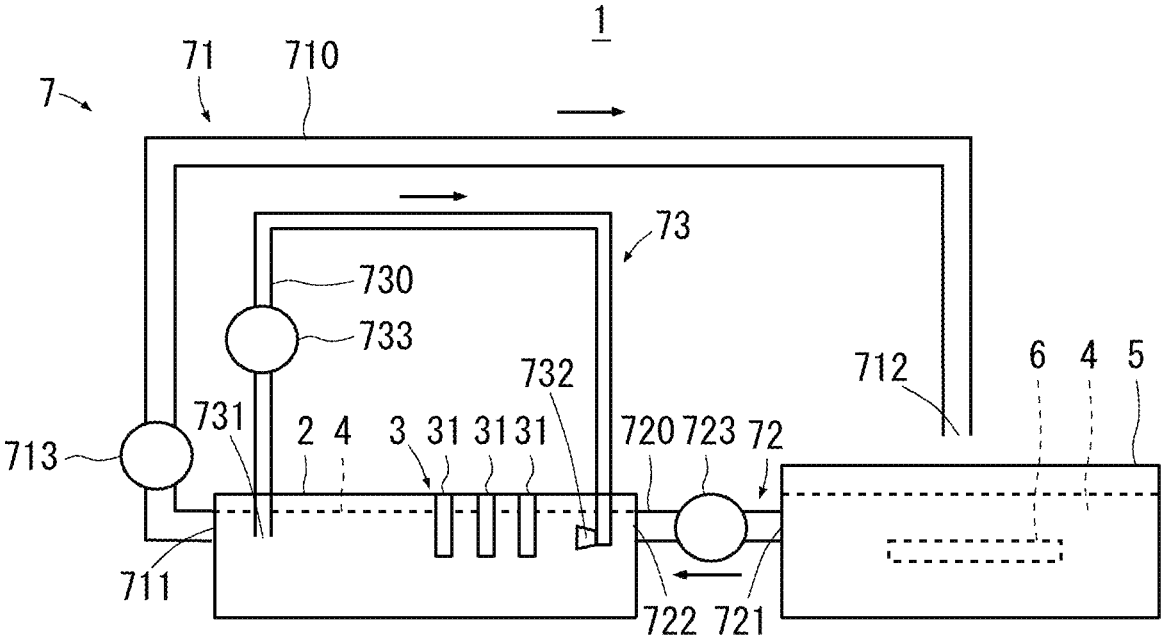
FIG. 9 is a schematic diagram of a chemical treatment solution regeneration apparatus according to another embodiment that is different from FIG. 3 to FIG. 8.

FIG. 9 is a schematic diagram of the chemical treatment solution regeneration apparatus 1 according to another embodiment that is different from FIG. 3 to FIG. 8. Referring to FIG. 9, the chemical treatment solution regeneration apparatus 1 includes the treatment solution regeneration bath 2, the light radiation apparatus 3, the chemical treatment bath 5 and the flow mechanism 7. The flow mechanism 7 includes the first liquid supply channel 71, the second liquid supply channel 72 and the under-regeneration-treatment-solution circulation channel 73.

In a case where the chemical treatment solution regeneration apparatus 1 includes the chemical treatment bath 5, and the flow mechanism 7 includes the under-regeneration-treatment-solution circulation channel 73 in addition to the first liquid supply channel 71 and the second liquid supply channel 72, the oxalate treatment solution 4 that is repeatedly irradiated with light inside the treatment solution regeneration bath 2 can be circulated to the chemical treatment bath 5. In this case, because the occasions at which the oxalate treatment solution 4 is irradiated with light from the light source member 31 increase, and the amount of the oxalate treatment solution 4 to be irradiated with light increase, a decrease in the chemical treatability can be further suppressed.

The flow rate in the first liquid supply channel 71 and in the second liquid supply channel 72 may be the same as or different from the flow rate in the under-regeneration-treatment-solution circulation channel 73. By having the under-regeneration-treatment-solution circulation channel 73, light is repeatedly radiated to the oxalate treatment solution 4 in the treatment solution regeneration bath 2. Therefore, even if the flow rate in the first liquid supply channel 71 and the second liquid supply channel 72 is slow, the oxalate treatment solution 4 can be efficiently subjected to regeneration treatment. Further, by speeding up the flow rate in the first liquid supply channel 71 and the second liquid supply channel 72, and/or the under-regeneration-treatment-solution circulation channel 73, the amount of the oxalate treatment solution 4 to be irradiated with light is increased, and the oxalate treatment solution 4 can be more efficiently subjected to regeneration treatment. For example, in a case where the flow rate in the under-regeneration-treatment-solution circulation channel 73 is made a fast flow rate, the oxalate treatment solution 4 can be efficiently subjected to regeneration treatment even in a case where the flow rate in the first liquid supply channel 71 and the second liquid supply channel 72 is slow.

SEVENTH EMBODIMENT

The bottom face of the treatment solution regeneration bath 2 may be inclined. When light is radiated to the oxalate treatment solution 4, as described above, insoluble iron (II) oxalate is formed. The iron (II) oxalate forms precipitate and settles inside the treatment solution regeneration bath 2. If the bottom face of the treatment solution regeneration bath 2 is inclined, the precipitate may accumulate at a lower part of the inclined bottom face. In this case, removal of the precipitate is facilitated.

Figure 10:
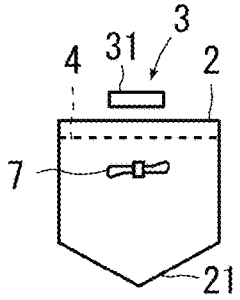
FIG. 10 is a schematic diagram illustrating an example of a treatment solution regeneration bath in which the bottom face is inclined.
Figure 11:
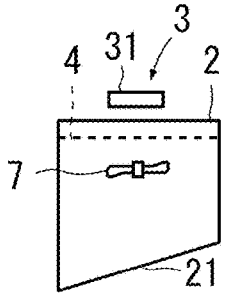
FIG. 11 is a schematic diagram illustrating an example of a treatment solution regeneration bath that is different from FIG. 10.
Figure 12:
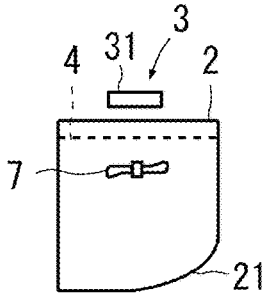
FIG. 12 is a schematic diagram illustrating an example of a treatment solution regeneration bath that is different from FIG. 10 and FIG. 11.

FIG. 10 to FIG. 12 are schematic diagrams illustrating examples of the treatment solution regeneration bath 2 in which the bottom face is inclined. Referring to FIG. 10, a bottom face 21 of the treatment solution regeneration bath 2 inclines linearly downward toward the center from both ends. In this case, the precipitate accumulates at the center portion of the treatment solution regeneration bath 2.

An inclination of the bottom face 21 of the treatment solution regeneration bath 2 is not limited to the example illustrated in FIG. 10. The bottom face 21 of the treatment solution regeneration bath 2, for example, may be inclined linearly downward from one end towards the other end as illustrated in FIG. 11. The direction in which the bottom face 21 inclines may also be the opposite direction to the direction illustrated in FIG. 11. The bottom face 21 of the treatment solution regeneration bath 2 may be inclined linearly downward from the center toward both ends so that the center is a convex shape. The bottom face 21 of the treatment solution regeneration bath 2 may, for example, inline in a curved manner as illustrated in FIG. 12 without inclining linearly.

EIGHTH EMBODIMENT

Figure 13:
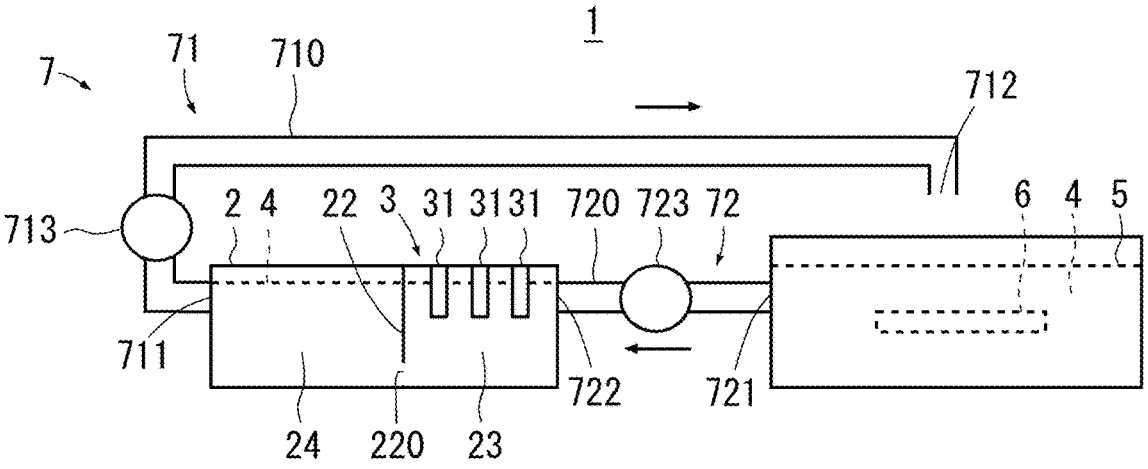
FIG. 13 is a schematic diagram of a chemical treatment solution regeneration apparatus according to another embodiment that is different from FIG. 3 to FIG. 12.

The treatment solution regeneration bath 2 may be partitioned into a light irradiation chamber and a sedimentation chamber by a partition member. FIG. 13 is a schematic diagram of the chemical treatment solution regeneration apparatus 1 according to another embodiment that is different from FIG. 3 to FIG. 12. Referring to FIG. 13, the treatment solution regeneration bath 2 is partitioned into a light irradiation chamber 23 and a sedimentation chamber 24 by a partition member 22. The partition member 22 has an opening portion 220 which connects the light irradiation chamber 23 and the sedimentation chamber 24. The one or more light source members 31 are disposed in the light irradiation chamber 23.

When the treatment solution regeneration bath 2 is partitioned into the light irradiation chamber 23 and the sedimentation chamber 24, light irradiation and the removal of precipitate can be performed in separate compartments. In this case, removal of precipitate can be performed more efficiently.

The size, shape and position of the partition member 22 are not particularly limited. The partition member 22 may be a plate-shaped member that extends downward from the top face of the treatment solution regeneration bath 2. Further, the direction of the partition member 22 may be the vertical direction or may be a direction that is inclined with respect to the vertical direction.

The opening portion 220 that connects the light irradiation chamber 23 and the sedimentation chamber 24 is preferably provided at the lower end of the partition member 22. The opening portion 220 may be provided only at the lower end of the partition member 22, or may be provided both at the lower end of the partition member 22 and at a position other than the lower end of the partition member 22. The size, number and position of the opening portion 220 can be appropriately adjusted within a range in which a desired flow rate of the oxalate treatment solution 4 is obtained and a range in which precipitate does not block up the opening portion 220 and obstruct the flow of the oxalate treatment solution 4.

NINTH EMBODIMENT

Figure 14:
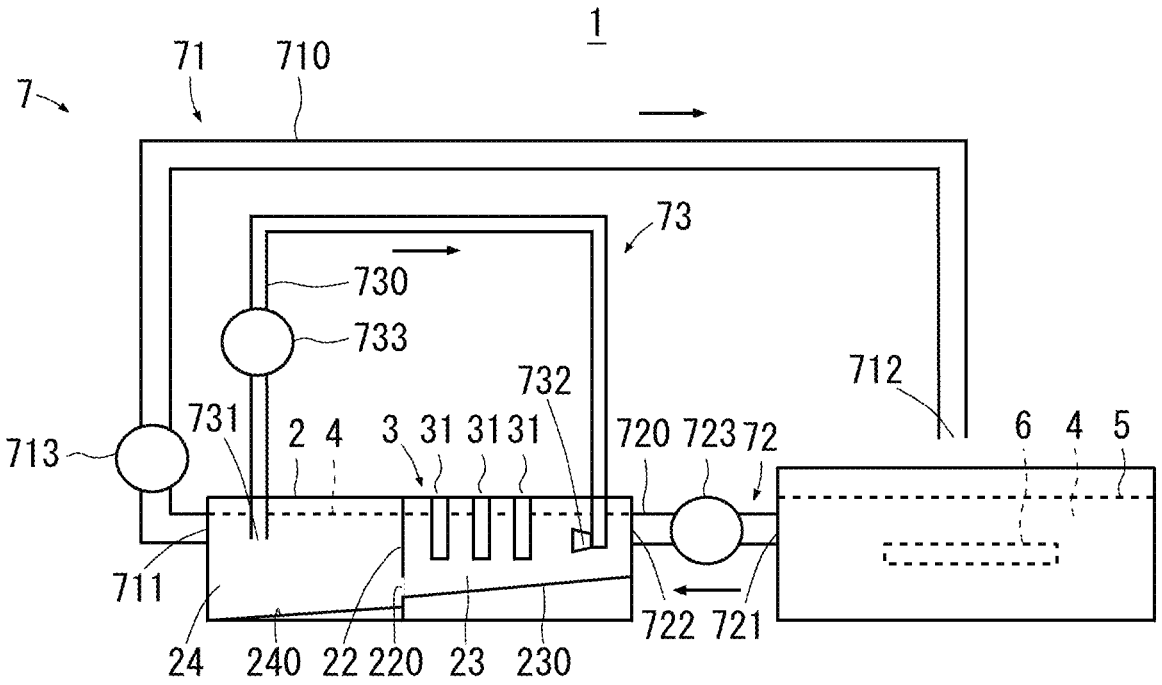
FIG. 14 is a schematic diagram of a chemical treatment solution regeneration apparatus according to another embodiment that is different from FIG. 3 to FIG. 13.

Preferably, the bottom face of the light irradiation chamber 23 becomes lower from the light irradiation chamber 23 toward the sedimentation chamber 24. FIG. 14 is a schematic diagram of the chemical treatment solution regeneration apparatus 1 according to another embodiment that is different from FIG. 3 to FIG. 13. In comparison to the chemical treatment solution regeneration apparatus 1 illustrated in FIG. 13, the chemical treatment solution regeneration apparatus 1 illustrated in FIG. 14 further includes the under-regeneration-treatment-solution circulation channel 73. A bottom face 230 of the light irradiation chamber 23 of the treatment solution regeneration bath 2 of the chemical treatment solution regeneration apparatus 1 illustrated in FIG. 14 is inclined linearly downward from the light irradiation chamber 23 toward the sedimentation chamber 24.

In a case where the bottom face 230 of the light irradiation chamber 23 becomes lower towards the sedimentation chamber 24 from the light irradiation chamber 23, after precipitate that is formed in the light irradiation chamber 23 deposits on the bottom face 230 of the light irradiation chamber 23, the precipitate moves under its own weight toward the sedimentation chamber 24. The precipitate passes through the opening portion 220 of the partition member 22 and accumulates in the sedimentation chamber 24. Therefore, removal of precipitate can be performed more efficiently.

In FIG. 14, a bottom face 240 of the sedimentation chamber 24 is also inclined. By this means, the precipitate that moved into the sedimentation chamber 24 moves under its own weight in accordance with the inclination of the bottom face 240 of the sedimentation chamber 24 and accumulates at a lower place. In this case, the removal of precipitate is further facilitated. However, the bottom face 240 of the sedimentation chamber 24 need not be inclined.

TENTH EMBODIMENT

Preferably, the treatment solution regeneration bath 2 also includes a current direction changing member. The current direction changing member is disposed so as to be immersible in the oxalate treatment solution 4 in the treatment solution regeneration bath 2, and changes the direction of the flow of the oxalate treatment solution 4 in the treatment solution regeneration bath 2.

Figure 15:
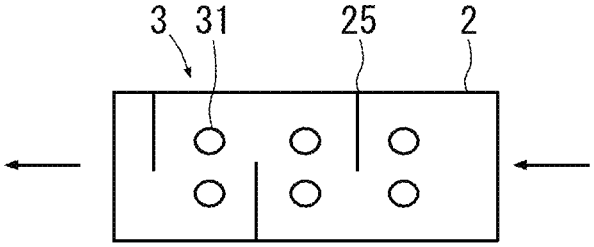
FIG. 15 is a plan view of a treatment solution regeneration bath illustrating the arrangement of current direction changing members.

FIG. 15 is a plan view of the treatment solution regeneration bath 2, that illustrates the arrangement of current direction changing members 25. The arrows in FIG. 15 indicate the direction which the oxalate treatment solution 4 flows. Referring to FIG. 15, the treatment solution regeneration bath 2 includes a current direction changing member 25. When the treatment solution regeneration bath 2 includes the current direction changing member 25, the directions of flows of the oxalate treatment solution 4 in the treatment solution regeneration bath 2 are not uniformly aligned in a fixed direction, and a turbulent flow can easily be generated. When a turbulent flow is generated, the amount of oxalate treatment solution 4 to be irradiated with light increases. Therefore, the oxalate treatment solution 4 can be subjected to regeneration treatment more efficiently.

The number, shape and size of the current direction changing member 25 are not particularly limited as long as the current direction changing member 25 can change the direction of the flow of the oxalate treatment solution 4. The number of current direction changing members 25 that are provided may be one, may be two, or may be three or more as illustrated in FIG. 15. The shape of the current direction changing member 25 may be a plate shape, may be a bar shape, may be spherical, may be a box shape, or may be tubular. For example, in a case where the shape of the current direction changing member 25 is a plate shape, the current direction changing member 25 may be curved or need not be curved.

Figure 16:
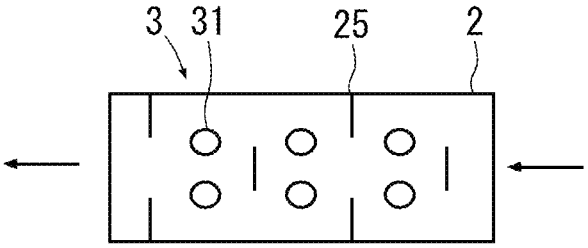
FIG. 16 is a plan view of a treatment solution regeneration bath illustrating the arrangement of current direction changing members that is different from FIG. 15.

The arrangement of the current direction changing member 25 can be appropriately adjusted within a range in which the current direction changing member 25 do not completely hold back the flow of the oxalate treatment solution 4. Preferably, the current direction changing member 25 is arranged between a plurality of the light source members 31 as illustrated in FIG. 15. In this case, a greater amount of the oxalate treatment solution 4 passes the vicinity of the light source members 31. Therefore, the amount of the oxalate treatment solution 4 to be irradiated with light increases. The current direction changing members 25 may be arranged such that a plurality of the plate-shaped current direction changing members 25 are disposed with regularity as illustrated, for example, in FIG. 16, or may be disposed irregularly.

ELEVENTH EMBODIMENT

Figure 17:
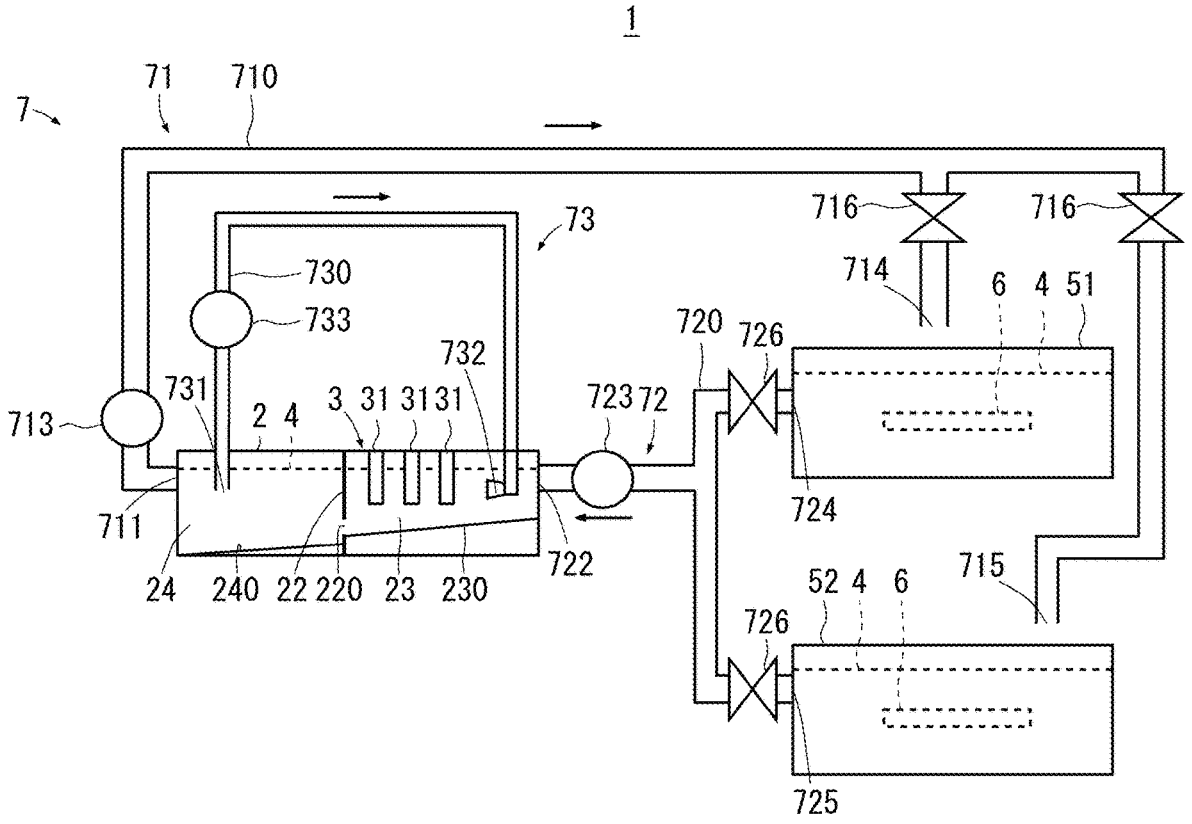
FIG. 17 is a schematic diagram of a chemical treatment solution regeneration apparatus according to another embodiment that is different from FIG. 3 to FIG. 16.

The chemical treatment solution regeneration apparatus 1 may have a combination of the features of the foregoing embodiments. FIG. 17 is a schematic diagram of the chemical treatment solution regeneration apparatus 1 according to another embodiment that is different from FIG. 3 to FIG. 16. Referring to FIG. 17, the chemical treatment solution regeneration apparatus 1 includes the treatment solution regeneration bath 2, the light radiation apparatus 3, the first chemical treatment bath 51 and the second chemical treatment bath 52, and causes the oxalate treatment solution 4 as a whole to circulate between the first chemical treatment bath 51 and second chemical treatment bath 52 and the treatment solution regeneration bath 2, and also causes the oxalate treatment solution 4 to circulate inside the treatment solution regeneration bath 2.

The chemical treatment solution regeneration apparatus 1 includes the treatment solution regeneration bath 2, the first chemical treatment bath 51 and second chemical treatment bath 52, the light radiation apparatus 3 and the flow mechanism 7. The treatment solution regeneration bath 2 is partitioned into the light irradiation chamber 23 and the sedimentation chamber 24 by the partition member 22. The bottom face 230 of the light irradiation chamber 23 and the bottom face 240 of the sedimentation chamber 24 both incline so as to become lower toward downstream from upstream of the flow of the oxalate treatment solution 4. The light source member 31 of the light radiation apparatus 3 is disposed so as to be immersible in the oxalate treatment solution 4 in the light irradiation chamber 23.

The flow mechanism 7 includes the first liquid supply channel 71, the second liquid supply channel 72 and the under-regeneration-treatment-solution circulation channel 73. The first liquid supply channel 71 conveys the oxalate treatment solution 4 in the treatment solution regeneration bath 2 to the first chemical treatment bath 51 and the second chemical treatment bath 52. The chemical treatment bath 5 side of the first liquid supply channel main body 710 of the first liquid supply channel 71 branches in two, and the first chemical-treatment-bath-side discharge port 714 and the second chemical-treatment-bath-side discharge port 715 are formed at the two end portions of the first liquid supply channel main body 710, respectively. The second liquid supply channel 72 conveys the oxalate treatment solution 4 in the first chemical treatment bath 51 and the second chemical treatment bath 52 to the treatment solution regeneration bath 2. The chemical treatment bath 5 side of the second liquid supply channel main body 720 of the second liquid supply channel 72 branches in two, and the first chemical-treatment-bath-side inflow port 724 and the second chemical-treatment-bath-side inflow port 725 are formed at the two end portions of the second liquid supply channel main body 720, respectively. The flow mechanism 7 also includes the discharge port switching mechanism 716 and the inflow port switching mechanism 726. By this means, an adjustment can be made regarding whether to cause the oxalate treatment solution 4 in the first chemical treatment bath 51 and/or the oxalate treatment solution 4 in the second chemical treatment bath 52 to circulate.

The under-regeneration-treatment-solution circulation channel 73 causes the oxalate treatment solution 4 in the treatment solution regeneration bath 2 to circulate. By this means, the amount of the oxalate treatment solution 4 to be irradiated with light can be increased, and the oxalate treatment solution 4 is efficiently regenerated. In FIG. 17, the under-regeneration-treatment-solution circulation channel 73 conveys the oxalate treatment solution 4 in the sedimentation chamber 24 to the light irradiation chamber 23.

After the oxalate treatment solution 4 undergoes the treatment solution regeneration step, the oxalate treatment solution 4 is transported to the chemical treatment bath 5. In the chemical treatment bath 5, chemical treatment is performed once more using the oxalate treatment solution 4 after the treatment solution regeneration step. The oxalate treatment solution 4 in the chemical treatment bath 5 after the oxalate treatment solution 4 was transported to the chemical treatment bath 5 may be the oxalate treatment solution 4 that is after undergoing the treatment solution regeneration step, or may be a mixture of unused oxalate treatment solution 4 and the oxalate treatment solution 4 that is after undergoing the treatment solution regeneration step. That is, it may be the oxalate treatment solution 4 which includes the oxalate treatment solution 4 after the treatment solution regeneration step.

OTHER EMBODIMENTS

The method for producing a chemically treated alloy material of the present disclosure is not limited to the aforementioned methods for producing a chemically treated alloy material. Development examples are described hereunder.

[Position of Light Source Member]

The light source member 31 is preferably arranged inside the treatment solution regeneration bath 2 in a manner in which light source member 31 is immersible in the oxalate treatment solution 4. The arrangement of the light source member 31 can be appropriately changed.

Figure 18:
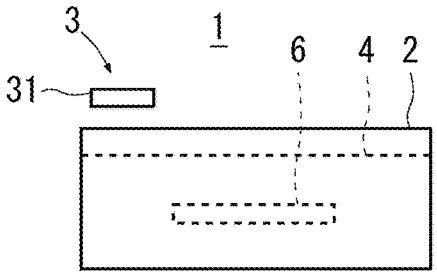
FIG. 18 is a schematic diagram illustrating an example of the arrangement of light source members.

FIG. 18 is a schematic diagram illustrating an example of the arrangement of the light source member 31. As illustrated in FIG. 18, the light source member 31 may be disposed in the vicinity of the outside of the treatment solution regeneration bath 2. For example, the light source member 31 may be disposed above the treatment solution regeneration bath 2. In this case, the top face of the treatment solution regeneration bath 2 is open, or a top plate composed of a member having translucency is mounted at a location facing the light source member 31. In a case where the light source member 31 is disposed above the treatment solution regeneration bath 2, preferably the light source member 31 is disposed as close as possible to the liquid surface of the treatment solution in order to suppress attenuation of the light when the light propagates through the atmosphere.

Figure 19:
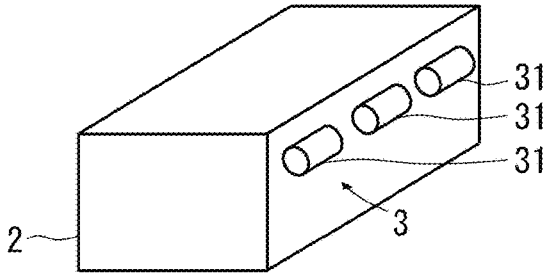
FIG. 19 is a schematic diagram illustrating an example of the arrangement of light source members that is different from FIG. 18.

Alternatively, a member having translucency may be used at one part of a side face of the treatment solution regeneration bath 2, and the light source member 31 may be disposed at the side of the treatment solution regeneration bath 2. FIG. 19 is a schematic diagram illustrating an example of the arrangement of the light source members 31 that is different from FIG. 18. For example, as illustrated in FIG. 19, a plurality of the light source members 31 having a cylindrical shape may be disposed so that the axial directions of the light source members 31 are aligned along a long side of the side faces on the outer side of the treatment solution regeneration bath 2.

In a case where the light source member 31 is disposed above the treatment solution regeneration bath 2, preferably the light source member 31 is disposed so as to be located within a range of 200 mm from the liquid surface of the treatment solution that is contained in the treatment solution regeneration bath 2, more preferably within a range of 100 mm, and further preferably within a range of 50 mm. Further, an a case where the light source member 31 is disposed at the side of the treatment solution regeneration bath 2, preferably the light source member 31 is disposed so as to be located within a range of 100 mm from the surface of a member having translucency of a side face of the treatment solution regeneration bath 2, and more preferably is mounted to the surface of the member having translucency.

Figure 20:
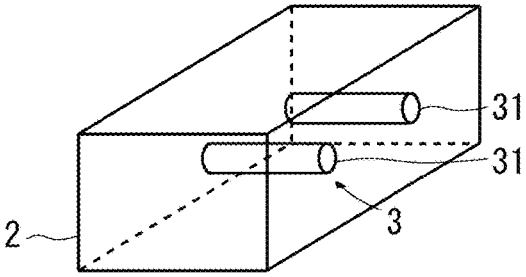
FIG. 20 is a schematic diagram illustrating an example of the arrangement of light source members that is different from FIG. 18 and FIG. 19.

FIG. 20 is a schematic diagram illustrating an example of the arrangement of the light source members 31 that is different from FIG. 18 and FIG. 19. Referring to FIG. 20, the light source members 31 having a cylindrical shape may be disposed so that each entire light source member 31 is disposed inside the treatment solution regeneration bath 2 in a manner in which the axial direction of the light source member 31 is aligned with the width direction of the treatment solution regeneration bath 2.

Figure 21:
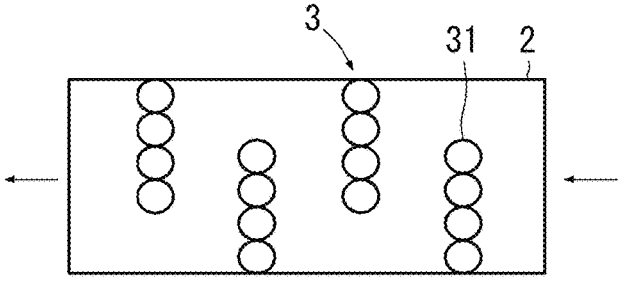
FIG. 21 is a schematic diagram illustrating an example of the arrangement of light source members that is different from FIG. 18 to FIG. 20.

FIG. 21 is a schematic diagram illustrating an example of the arrangement of the light source members 31 that is different from FIG. 18 to FIG. 20. FIG. 21 is a view in which the treatment solution regeneration bath 2 is seen from above. The arrows in FIG. 21 indicate the direction of the flow of the oxalate treatment solution 4. In a case in which a plurality of the light source members 31 are provided inside the treatment solution regeneration bath and which is a case where the oxalate treatment solution 4 flows, as illustrated in FIG. 21, the light source members 31 may be arranged in series in a direction that is orthogonal to the direction of the flow of the oxalate treatment solution 4, or may be arranged randomly with respect to the direction of the flow of the oxalate treatment solution 4.

[Shape of Treatment Solution Regeneration Bath]

The shape of the treatment solution regeneration bath 2 is not particularly limited as long as the shape enables light to be radiated to the oxalate treatment solution 4, and the shape can be altered as appropriate.

Figure 22:
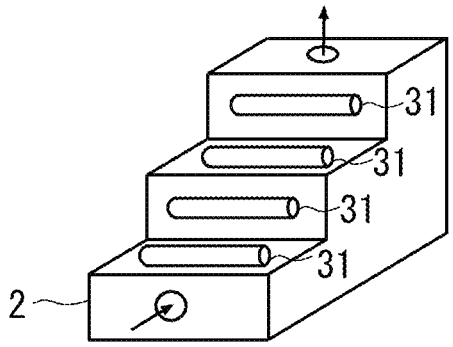
FIG. 22 is a schematic diagram illustrating an example of the shape of a treatment solution regeneration bath.

FIG. 22 is a schematic diagram illustrating an example of the shape of the treatment solution regeneration bath 2. The arrows in FIG. 22 indicate the direction of the flow of the oxalate treatment solution 4 in the treatment solution regeneration bath 2. Referring to FIG. 22, in the treatment solution regeneration bath 2, one side face may be a box shape that is formed in a stepped shape. In this case, for example, a plurality of the light source members 31 having a cylindrical shape may be disposed so that the axial direction thereof is along the width direction of the treatment solution regeneration bath 2, with one light source member 31 being disposed in each step of the stepped side face. In this case, the area that can be irradiated with light from the light source member 31 increases. As a result, the oxalate treatment solution 4 can be subjected to regeneration treatment more efficiently.

Figure 23:
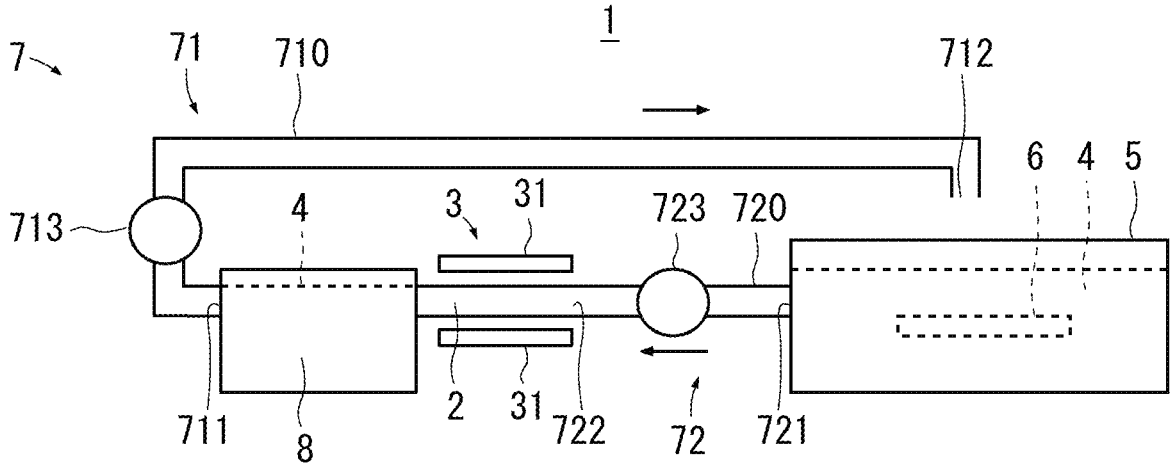
FIG. 23 is a schematic diagram illustrating an example of the shape of a treatment solution regeneration bath that is different from FIG. 22.

FIG. 23 is a schematic diagram illustrating an example of the shape of the treatment solution regeneration bath 2 that is different from FIG. 22. The treatment solution regeneration bath 2 may be one part of a liquid supply channel. The treatment solution regeneration bath 2 illustrated in FIG. 23 is one part of the liquid supply channel main body 720. In FIG. 23, the light source members 31 are disposed in the vicinity of the outer side of the treatment solution regeneration bath 2. In this case, at least a face of the treatment solution regeneration bath 2 which faces the light source member 31 is composed of a member having translucency. The light source members 31 may be disposed above and below the treatment solution regeneration bath 2 as illustrated in FIG. 23, or may be disposed so as to surround the outside of the treatment solution regeneration bath 2 that is a liquid supply channel. Although in the example illustrated in FIG. 23 a sedimentation bath 8 is disposed downstream of the treatment solution regeneration bath 2, the sedimentation bath 8 need not be provided.

Figure 24:
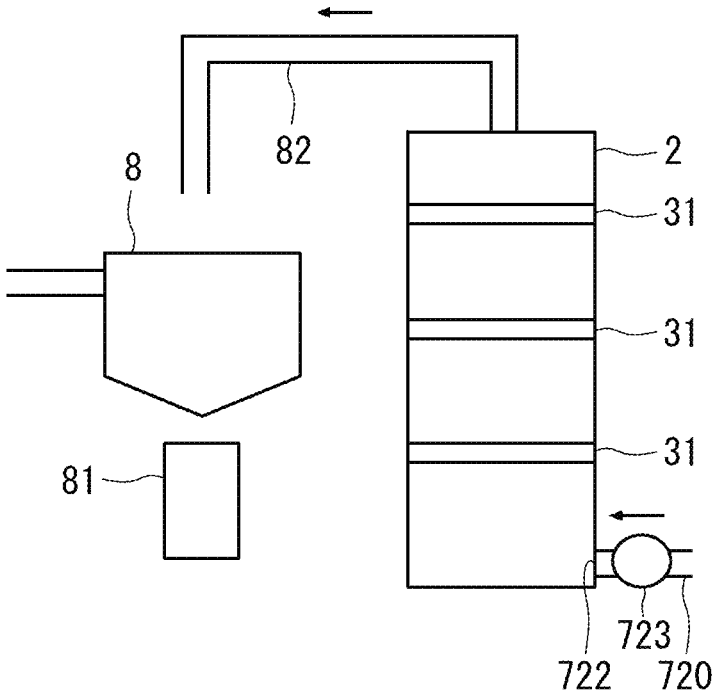
FIG. 24 is a schematic diagram illustrating an example of the shape of a treatment solution regeneration bath that is different from FIG. 22 and FIG. 23.

FIG. 24 is a schematic diagram illustrating an example of the shape of the treatment solution regeneration bath 2 that is different from FIG. 22 and FIG. 23. Referring to FIG. 24, the treatment solution regeneration bath 2 may be, for example, a tower shape. Specifically, the treatment solution regeneration bath 2 is a rectangular parallelepiped shape that has long sides extending in the vertical direction, and the light source members 31 are disposed inside the treatment solution regeneration bath 2. The light source member 31 is cylindrical, and a plurality of the light source members 31 are disposed so that the longitudinal direction thereof is perpendicular to the direction of the flow of the oxalate treatment solution 4 in the treatment solution regeneration bath 2. The oxalate treatment solution 4 flows into the treatment solution regeneration bath 2 from a lower portion of the treatment solution regeneration bath 2, and flows from the lower portion toward the upper portion of the treatment solution regeneration bath 2. The oxalate treatment solution 4 that is discharged from the upper portion of the treatment solution regeneration bath 2 passes through a liquid supply channel 82, and is discharged into the sedimentation bath 8 provided ahead of the liquid supply channel 82. The lower portion of the sedimentation bath 8 is openable, and a removal apparatus 81 for recovering precipitate is disposed below the sedimentation bath 8. A side face of the sedimentation bath 8 has a hole, and the oxalate treatment solution 4 in the sedimentation bath 8 is discharged from the hole in the side face of the sedimentation bath 8.

Figure 25:
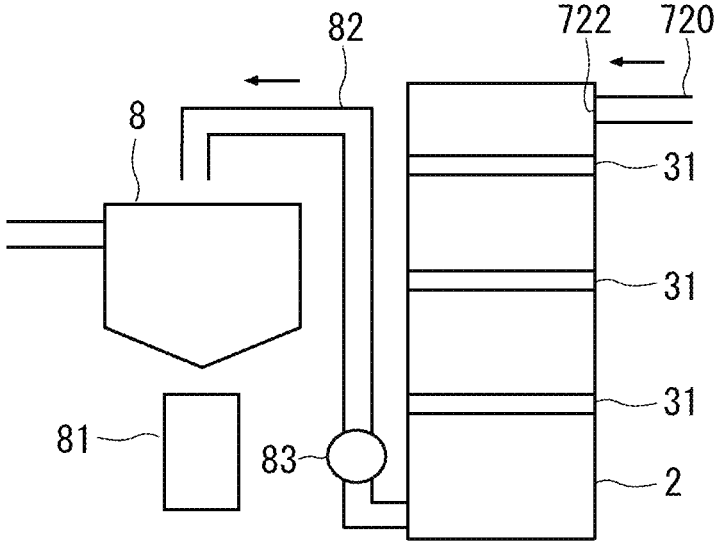
FIG. 25 is a schematic diagram illustrating an example of the shape of a treatment solution regeneration bath that is different from FIG. 22 to FIG. 24.

FIG. 25 is a schematic diagram illustrating an example of the shape of the treatment solution regeneration bath 2 that is different from FIG. 22 to FIG. 24. Referring to FIG. 25, the treatment solution regeneration bath 2 may be a tower shape in which the oxalate treatment solution 4 flows from the upper portion toward the lower portion. In this case, the treatment solution regeneration bath 2 has, in the upper portion, an opening portion through which the oxalate treatment solution 4 flows into the treatment solution regeneration bath 2, and has an opening portion through which the oxalate treatment solution 4 is discharged in the lower portion. A driving source 83 for feeding liquid may be disposed on the liquid supply channel 82 between the treatment solution regeneration bath 2 and the sedimentation bath 8. The remaining configuration of the example in FIG. 25 is the same as the configuration of the example in FIG. 24.

Other Arrangement Examples

In a case where the chemical treatment solution regeneration apparatus 1 includes the chemical treatment bath 5, the arrangement of the treatment solution regeneration bath 2 and the chemical treatment bath 5 can be changed as appropriate.

Figure 26:
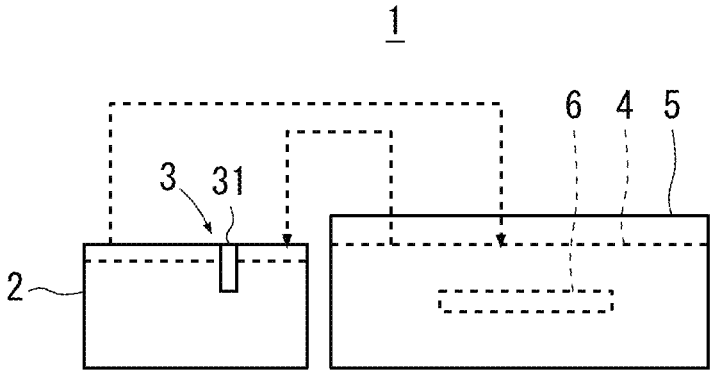
FIG. 26 is a schematic diagram of a chemical treatment solution regeneration apparatus according to another embodiment that is different from FIG. 3 to FIG. 25.

FIG. 26 is a schematic diagram of the chemical treatment solution regeneration apparatus 1 according to another embodiment that is different from FIG. 3 to FIG. 25. Referring to FIG. 26, the chemical treatment solution regeneration apparatus 1 includes the treatment solution regeneration bath 2 and the chemical treatment bath 5. The treatment solution regeneration bath 2 and the chemical treatment bath 5 are not connected. The light source member 31 is disposed inside the treatment solution regeneration bath 2.

In the case of using the chemical treatment solution regeneration apparatus 1 illustrated in FIG. 26, the oxalate treatment solution 4 that underwent regeneration treatment is returned to the chemical treatment bath 5 by transportation means, and is again utilized for chemical treatment. The term "transportation means" refers to, for example, transportation by a container. In this case, the oxalate treatment solution 4 in the chemical treatment bath 5 is the oxalate treatment solution 4 after undergoing the treatment solution regeneration step or is a mixture of unused oxalate treatment solution 4 and the oxalate treatment solution 4 after undergoing the treatment solution regeneration step.

Figure 27:
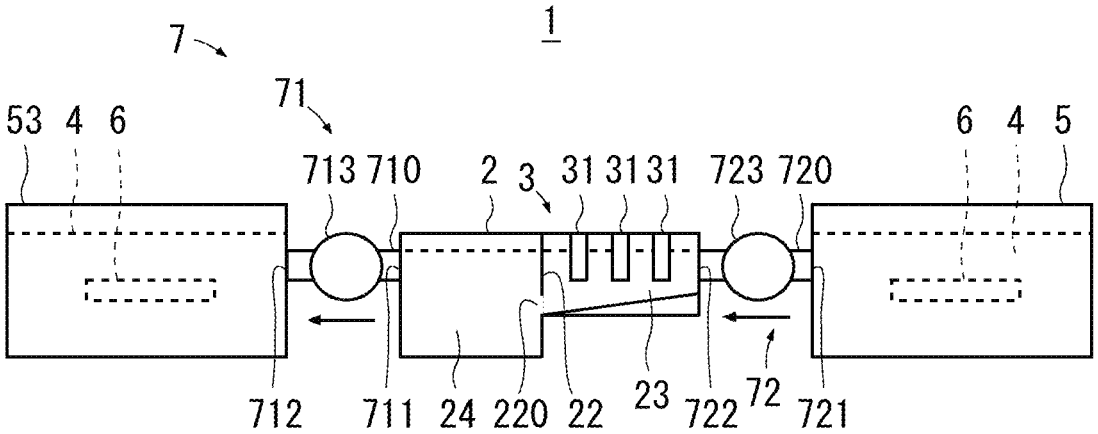
FIG. 27 is a schematic diagram of a chemical treatment solution regeneration apparatus according to another embodiment that is different from FIG. 3 to FIG. 26.

FIG. 27 is a schematic diagram of the chemical treatment solution regeneration apparatus 1 according to another embodiment that is different from FIG. 3 to FIG. 26. Referring to FIG. 27, the oxalate treatment solution 4 that underwent regeneration treatment in the treatment solution regeneration bath 2 need not necessarily be returned to the same chemical treatment bath 5. In the embodiment illustrated in FIG. 27, after the oxalate treatment solution 4 that was in the chemical treatment bath 5 undergoes regeneration treatment inside the treatment solution regeneration bath 2, the oxalate treatment solution 4 is discharged into a chemical treatment bath 53 that is different from the chemical treatment bath 5. For example, the oxalate treatment solution 4 in the chemical treatment bath 53 may be returned to the chemical treatment bath 5 by means of an unshown liquid supply channel. In this case, the embodiment is of a form in which the chemical treatment solution is regenerated after being used in both of the chemical treatment bath 53 and the chemical treatment bath 5. By this means, even in a case where chemical treatment is performed repeatedly in the chemical treatment bath 5 and the chemical treatment bath 53, a decrease in the chemical treatability is suppressed. Alternatively, unused oxalate treatment solution 4 may be supplied to the chemical treatment bath 5, and the oxalate treatment solution 4 that is in the chemical treatment bath 53 may be discarded after performing chemical treatment. In this case, even when using the oxalate treatment solution 4 after the oxalate treatment solution 4 was used for chemical treatment inside the chemical treatment bath 5, a decrease in the chemical treatability within the chemical treatment bath 53 is suppressed.

EXAMPLE

As an example, a test was performed with respect to decreasing iron ions by light irradiation. An oxalate treatment solution having the following composition was prepared.

Ferrbond 3819A (produced by Nihon Parkerizing Co., Ltd.)
Oxalic acid: 92%
Sodium bifluoride: 1 to 8%
Ferrbond 3819B (produced by Nihon Parkerizing Co., Ltd.)
Sodium nitrate: 40 to 50%
In the test, an oxalate treatment solution in which Ferrbond 3819A and Ferrbond 3819B were mixed at a mass ratio of Ferrbond 3819A: Ferrbond 3819B=4:1 was used.

The prepared oxalate treatment solution was used to perform a chemical treatment on a duplex stainless steel material (ASTM UNS 539274) containing 25% of Cr, 7% of Ni, 3% of Mo, and 2% of W. The chemical treatment conditions were treatment at 90° C. for 20 minutes.

[Light Irradiation Test]

Ultraviolet light was radiated to the oxalate treatment solution after the chemical treatment, and the iron ion content of the oxalate treatment solution before and after the ultraviolet light irradiation was measured. The ultraviolet light radiation conditions were a wavelength of 365 nm, and an radiation time of six minutes. The oxalate treatment solution before ultraviolet irradiation and the oxalate treatment solution after ultraviolet irradiation were each analyzed using an emission spectrophotometer (ICP-OES) PS7800 manufactured by Hitachi High-Technologies Corporation. The measurement results are shown in FIG. 1.

[Chemical Treatment Test]

A chemical treatment test was performed using an unused oxalate treatment solution, a used oxalate treatment solution, and a used oxalate treatment solution after ultraviolet irradiation. The alloy material subjected to the chemical treatment was an alloy material with a Cr content of 25%. The conditions of the chemical treatment were treatment at a temperature of 90° C. for 20 minutes. The potential on the alloy material surface during the chemical treatment was measured using a potentiostat in a manner in which a saturated calomel electrode was adopted as a reference electrode. The results are shown in FIG. 2.

[Test Results]

Referring to FIG. 1, when the used oxalate treatment solution was subjected to ultraviolet irradiation, the iron ion content decreased. Further, referring to FIG. 2, by subjecting the used oxalate treatment solution to ultraviolet irradiation ("Regenerated Treatment Solution" in FIG. 2), the chemical treatability were restored to the same level as the chemical treatability of the unused oxalate treatment solution ("Unused Solution" in FIG. 2).

Embodiments of the present invention have been described above. However, the foregoing embodiments are merely examples for implementing the present invention. Accordingly, the present invention is not limited to the above embodiments, and the above embodiments can be appropriately modified within a range which does not deviate from the gist of the present invention.

REFERENCE SIGNS LIST

1 Chemical Treatment Solution Regeneration Apparatus
2 Treatment Solution Regeneration Bath
3 Light radiation apparatus
4 Oxalate Treatment Solution
6 Alloy Material
31 Light Source Member

The invention claimed is:

1. A method for producing a chemically treated alloy material, wherein the alloy material contains Fe, comprising:
a chemical treatment step of immersing an alloy material in an oxalate treatment solution containing oxalate ions and fluorine ions to perform chemical treatment of the alloy material; and
a treatment solution regeneration step of radiating light at the oxalate treatment solution during the chemical treatment and/or the oxalate treatment solution after the chemical treatment, wherein at least one part of a light source member is immersed in the oxalate treatment solution in a treatment solution regeneration bath.

2. The method for producing a chemically treated alloy material according to claim 1, wherein:
in the treatment solution regeneration step,
light is radiated to the oxalate treatment solution while causing the oxalate treatment solution to flow.

3. The method for producing a chemically treated alloy material according to claim 1, wherein:
in the treatment solution regeneration step,
wavelengths of the light include a wavelength in an ultraviolet range.

4. The method for producing a chemically treated alloy material according to claim 1, further comprising:

a step of adding oxalate ions to the oxalate treatment solution.

5. The method for producing a chemically treated alloy material according to claim 1, wherein:

the oxalate treatment solution further contains nitrate ions.

6. The method for producing a chemically treated alloy material according to claim 1, wherein:

the oxalate treatment solution further contains thiosulfate ions.

7. The method for producing a chemically treated alloy material according to claim 1, wherein:

the alloy material contains 10.5% or more of Cr.

8. A chemical treatment solution regeneration apparatus, comprising:

a treatment solution regeneration bath capable of containing an oxalate treatment solution that contains oxalate ions and fluorine ions, during chemical treatment or after the chemical treatment of an alloy material containing Fe; and a light radiation apparatus that includes one or more light source members, with at least one part of the light source member being disposed inside the treatment solution regeneration bath or in a vicinity of an outer side of the treatment solution regeneration bath, the light radiation apparatus being capable of radiating light at the oxalate treatment solution during the chemical treatment or after the chemical treatment.

9. The chemical treatment solution regeneration apparatus according to claim 8, wherein:

at least one part of the light source member is immersible in the oxalate treatment solution in the treatment solution regeneration bath.

10. The chemical treatment solution regeneration apparatus according to claim 8, further comprising:

a flow mechanism that causes the oxalate treatment solution in the treatment solution regeneration bath to flow.

11. The chemical treatment solution regeneration apparatus according to claim 10, further comprising:

a chemical treatment bath capable of containing the oxalate treatment solution after being irradiated with the light by the light radiation apparatus in the treatment solution regeneration bath, the chemical treatment bath allowing the chemical treatment to be performed by immersing the alloy material in the oxalate treatment solution that is contained in the chemical treatment bath;

wherein the flow mechanism comprises:

a first liquid supply channel that conveys the oxalate treatment solution in the treatment solution regeneration bath to the chemical treatment bath, and a second liquid supply channel that conveys the oxalate treatment solution in the chemical treatment bath to the treatment solution regeneration bath.

12. The chemical treatment solution regeneration apparatus according to claim 11, wherein:

the chemical treatment bath includes:

a first chemical treatment bath and a second chemical treatment bath;

the first liquid supply channel including:

a first liquid supply channel main body having two end portions on the chemical treatment bath side, a first chemical-treatment-bath-side discharge port that is formed at one of the end portions on the chemical treatment bath side of the first liquid supply channel main body and that discharges the oxalate treatment solution in the first liquid supply channel main body into the first chemical treatment bath, and a second chemical-treatment-bath-side discharge port that is formed at the other of the end portions on the chemical treatment bath side of the first liquid supply channel main body and that discharges the oxalate treatment solution in the first liquid supply channel main body into the second chemical treatment bath;

the second liquid supply channel including:

a second liquid supply channel main body having two end portions on the chemical treatment bath side, a first chemical-treatment-bath-side inflow port that is formed at one of the end portions on the chemical treatment bath side of the second liquid supply channel main body and that allows the oxalate treatment solution in the first chemical treatment bath to flow into the second liquid supply channel main body, and a second chemical-treatment-bath-side inflow port that is formed at the other of the end portions on the chemical treatment bath side of the second liquid supply channel main body and that allows the oxalate treatment solution in the second chemical treatment bath to flow into the second liquid supply channel; and the flow mechanism further comprises:

a discharge port switching mechanism that switches whether to cause the oxalate treatment solution in the first liquid supply channel main body to be discharged from the first chemical-treatment-bath-side discharge port or from the second chemical-treatment-bath-side discharge port, and an inflow port switching mechanism that switches whether to cause the oxalate treatment solution to flow into the second liquid supply channel main body from the first chemical-treatment-bath-side inflow port or from the second chemical-treatment-bath-side inflow port.

13. The chemical treatment solution regeneration apparatus according to claim 10, wherein:

the flow mechanism comprises:

an under-regeneration-treatment-solution circulation channel that causes the oxalate treatment solution in the treatment solution regeneration bath to circulate;

the under-regeneration-treatment-solution circulation channel comprises:

an under-regeneration-treatment-solution circulation channel main body having two end portions, the under-regeneration-treatment-solution circulation channel main body being capable of containing one part of the oxalate treatment solution in the treatment solution regeneration bath, an under-regeneration-treatment-solution inflow port that is formed at one of the end portions of the under-regeneration-treatment-solution circulation channel main body, and that allows the oxalate treatment solution in the treatment solution regeneration bath to flow into the under-regeneration-treatment-solution circulation channel main body, an under-regeneration-treatment-solution discharge port that is formed at the other end portion of the under-regeneration-treatment-solution circulation channel main body, and that discharges the oxalate treatment solution in the under-regeneration-treatment-solution circulation channel main body into the treatment solution regeneration bath, and an under-regeneration-treatment-solution circulation driving source that causes the oxalate treatment solution in the under-regeneration-treatment-solution circulation channel main body to move from the under-regeneration-treatment-solution inflow port to the under-regeneration-treatment-solution discharge port; and at least one of the light source members is disposed between the under-regeneration-treatment-solution inflow port and the under-regeneration-treatment-solution discharge port.

14. The chemical treatment solution regeneration apparatus according to claim 8, wherein:

at least one part of a bottom face of the treatment solution regeneration bath is inclined.

15. The chemical treatment solution regeneration apparatus according to claim 8, wherein:

the treatment solution regeneration bath is partitioned into a light irradiation chamber and a sedimentation chamber by a partition member;

the partition member has an opening portion that connects the light irradiation chamber and the sedimentation chamber; and the one or more light source members are disposed in the light irradiation chamber.

16. The chemical treatment solution regeneration apparatus according to claim 15, wherein:

a bottom face of the light irradiation chamber becomes lower in a direction from the light irradiation chamber toward the sedimentation chamber.

17. The chemical treatment solution regeneration apparatus according to claim 10, wherein:

the treatment solution regeneration bath further comprises a current direction changing member that is disposed so as to be immersible in the oxalate treatment solution in the treatment solution regeneration bath and that changes a direction of a flow of the oxalate treatment solution in the treatment solution regeneration bath.

18. The chemical treatment solution regeneration apparatus according to claim 8, wherein:

the light radiation apparatus is an ultraviolet radiation apparatus.

* * * * *